US005682862A

United States Patent [19]

Sato et al.

[11] Patent Number: 5,682,862

[45] Date of Patent: Nov. 4, 1997

[54] CONTROL OF PURGE RATE OF EVAPORATED FUEL PURGING UNIT FOR INTERNAL COMBUSTION ENGINE

[75] Inventors: Kazuhiro Sato; Yutaka Kawamoto, both of Kanagawa Pref., Japan

[73] Assignee: Nissan Motor Co., Ltd., Kanagawa, Japan

[21] Appl. No.: 437,769

[22] Filed: May 9, 1995

Related U.S. Application Data

[63] Continuation-in-part of Ser. No. 208,897, Mar. 14, 1994, abandoned.

[30] Foreign Application Priority Data

| | | | |
|---|---|---|---|
| Mar. 12, 1993 | [JP] | Japan | 5-051744 |
| May 9, 1994 | [JP] | Japan | 6-094716 |
| May 9, 1994 | [JP] | Japan | 6-094717 |

[51] Int. Cl.[6] ..... F02M 37/04

[52] U.S. Cl. ..... 123/520; 123/198 D

[58] Field of Search ..... 123/520, 519, 123/518, 516, 198 D, 521

[56] References Cited

U.S. PATENT DOCUMENTS

| | | | |
|---|---|---|---|
| 4,961,412 | 10/1990 | Furuyama . | |
| 5,143,040 | 9/1992 | Okawa | 123/520 |
| 5,170,765 | 12/1992 | Hoshino | 123/520 |
| 5,216,991 | 6/1993 | Iida . | |
| 5,216,997 | 6/1993 | Osanai . | |
| 5,269,279 | 12/1993 | Mukai . | |
| 5,299,546 | 4/1994 | Kato . | |
| 5,343,846 | 9/1994 | Ogawa . | |
| 5,363,832 | 11/1994 | Suzumura . | |
| 5,371,412 | 12/1994 | Iwashita | 123/520 |
| 5,373,822 | 12/1994 | Thompson . | |
| 5,465,703 | 11/1995 | Abe | 123/520 |
| 5,479,904 | 1/1996 | Fujimori | 123/520 |

FOREIGN PATENT DOCUMENTS

| | | |
|---|---|---|
| 53-19729 | 6/1978 | Japan . |
| 63-39787 | 8/1988 | Japan . |

*Primary Examiner*—Carl S. Miller

*Attorney, Agent, or Firm*—Lowe, Price, LeBlanc & Becker

[57] ABSTRACT

A method of purging a canister is disclosed, wherein purge ratio is variably controlled under predetermined condition when air fuel ratio closed loop or feedback control based on output of an oxygen sensor is effected. Accumulated amount of purge air (EVPCNT) is calculated. The purge rate is increased as EVPCNT increases. But, when EVPCNT exceeds a predetermined large value (N), the purge rate is fixed at a very small value, for example 1% since the fuel remainder in the canister is considered minimum. As purging process proceeds, i.e., as EVPCNT increases, the percentage of evaporated fuel within the purge air is subject to a drop. To compensate for this drop, the purge rate is increased to cause the purge air to increase in amount, thereby to keep a ratio of flow rate of evaporated fuel to flow rate of air constant.

45 Claims, 23 Drawing Sheets

START
100
λ CONTROL ?
NO
YES
102
PR CONTROL REQUIRED ?
NO
YES
INPUT : QIA
110
INC = QIA × PR × KDUTY
112
EVPCNT ← EVPCNT+INC
114
116
EVPCNT ≦ N ?
NO
YES
118
TABLE LOOK-UP OF FIG.4 TO DETERMINE PR
104
PR ← 1%
DETERMINE DUTY FOR PR
106
OUTPUT : DUTY
108
RETURN

CONTROL OF PURGE RATE OF EVAPORATED FUEL PURGING UNIT FOR INTERNAL COMBUSTION ENGINE

RELATED APPLICATIONS

This application is a continuation-in-part of U.S. Ser. No. 08/208,897, filed on Mar. 14, 1994, now abandoned.

BACKGROUND OF THE INVENTION

1. Field of the Invention

The present invention relates to a method of and a system for purging a canister of an evaporated fuel purging unit.

2. Background of the Related Art

Japanese Patent Second Publication (JP-B) No. 53-19729 discloses an evaporated fuel purging unit. According to this known purging unit, when the pressure within a fuel tank reaches a predetermined positive value, fuel vapor is admitted to a canister filled with absorbent, such as activated charcoal, to be absorbed by the activated charcoal. The fuel vapor absorbed by the activated charcoal is purged by air through a purge passage in to the engine induction passage during operation of the engine.

Japanese Patent Second Publication (JP-B) No. 63-39787 discloses a purge control method. According to this known purge control method, a solenoid operated flow control valve in a purge passage is gradually opened after the start of purging evaporated fuel into the engine induction passage and gradually closed before the end of the purging process.

A main object of the present invention is to improve a method of and system for purging a canister containing absorbent such that total amount of purged fuel is increased while suppressing fluctuation of air fuel ratio of combustible charge during the purging process.

SUMMARY OF THE INVENTION

According to one aspect of the present invention, there is provided a method of purging a canister containing an absorbent, the canister being connected to a fuel tank to permit thereinto evaporated fuel from the fuel tank to be absorbed by the absorbent, the canister having a purge air inlet and a purge air outlet connected to one end of a purge passage having therein a flow control valve, the purge passage having an opposite end connected to an induction passage of an internal combustion engine at a portion downstream of a throttle valve disposed in the induction passage, the method comprising the steps of:

detecting flow of intake air passing through the induction passage at a portion upstream of the throttle valve and generating an intake air flow indicative signal indicative of the detected flow of intake air;

deriving an intake air flow rate from said intake air flow indicative signal;

calculating a product of said derived intake air flow rate and a purge rate;

incrementing a counter by a value proportional to said calculated product;

determining a target value of said purge rate in response to said counter; and adjusting the flow control valve in response to said determined target value of said purge rate.

According to another aspect of the present invention, there is provided a method of purging a canister containing an absorbent, the canister being connected to a fuel tank to permit thereinto evaporated fuel from the fuel tank to be absorbed by the absorbent, the canister having a purge air inlet and a purge air outlet connected to one end of a purge passage having therein a flow control valve, the purge passage having an opposite end connected to an induction passage of an internal combustion engine at a portion downstream of a throttle valve disposed in the induction passage, the method comprising the steps of:

detecting flow of intake air passing through the induction passage at a portion upstream of the throttle valve and generating an intake air flow indicative signal indicative of the detected flow of intake air;

deriving an intake air flow rate from said intake air flow indicative signal;

calculating a product of said derived intake air flow rate and a purge rate;

determining a target value of said purge rate out of various values of said purge rate contained in a table in response to said counter, the arrangement being such that, with a predetermined target value of deviation from the stoichiometry, said various values of said purge rate contained in said table are dependent on various values of said counter; and adjusting the flow control valve in response to said determined target value of said purge rate.

According to another aspect of the present invention, there is provided a method of purging a canister containing an absorbent, the canister being connected to a fuel tank to permit thereinto evaporated fuel from the fuel tank to be absorbed by the absorbent, the canister having a purge air inlet and a purge air outlet connected to one end of a purge passage having therein a flow control valve, the purge passage having an opposite end connected to an induction passage of an internal combustion engine at a portion downstream of a throttle valve disposed in the induction passage, the method comprising the steps of:

accumulating an amount of fuel vapor purged from the canister after the engine starts;

storing the accumulated purge fuel vapor amount at least for a predetermined time after the engine stops;

detecting a time interval between a time at which the engine stops and a time at which the engine restarts;

setting a purge rate characteristic based on the accumulated purge fuel vapor amount stored when the engine starts and the detected time interval, the purge rate characteristic defining purge rate as a function of accumulated purge fuel vapor amount after the engine starts;

calculating a purge rate according to the set purge rate characteristic; and adjusting the flow control valve to provide the calculated purge rate.

According to another aspect of the present invention, there is provided a method of purging a canister containing an absorbent, the canister being connected to a fuel tank to permit thereinto evaporated fuel from the fuel tank to be absorbed by the absorbent, the canister having a purge air inlet and a purge air outlet connected to one end of a purge passage having therein a flow control valve, the purge passage having an opposite end connected to an induction passage of an internal combustion engine at a portion downstream of a throttle valve disposed in the induction passage, the method comprising the steps of:

detecting engine operating conditions;

calculating a required purge flow rate based on the detected engine operating conditions;

controlling, the flow control valve based on the detected engine operating conditions and the calculated required purge flow rate;

calculating a maximum possible purge flow rate based on the detected engine operating conditions;

accumulating a lower one of the required purge flow rate and the maximum possible purge flow rate after the engine starts; and correcting the required purge flow rate based on the accumulated purge flow rate.

According to still another aspect of the present invention, there is provided a system for purging a canister containing an absorbent, the canister being connected to a fuel tank to permit thereinto evaporated fuel from the fuel tank to be absorbed by the absorbent, the canister having a purge air inlet and a purge air outlet connected to one end of a purge passage, the purge passage having an opposite end connected to an induction passage of an internal combustion engine at a portion downstream of a throttle valve disposed in the induction passage, the system comprising:

means for detecting flow of intake air passing through the induction passage at a portion upstream of the throttle valve and generating an intake air flow indicative signal indicative of the detected flow of intake air;

a control unit which derives an intake air flow rate from said intake air flow indicative signal; calculates a product of said derived intake air flow rate and a purge rate; increments a counter by a value proportional to said calculated product; determines a target value of said purge rate in response to said counter; and produces an output signal in response to said determined target value of said purge rate; and means for controlling the purge passage in response to said control signal.

According to another aspect of the present invention, there is provided a system for purging a canister containing an absorbent, the canister being connected to a fuel tank to permit thereinto evaporated fuel from the fuel tank to be absorbed by the absorbent, the canister having a purge air inlet and a purge air outlet connected to one end of a purge passage, the purge passage having an opposite end connected to an induction passage of an internal combustion engine at a portion downstream of a throttle valve disposed in the induction passage, the system comprising:

means for detecting flow of intake air passing through the induction passage at a portion upstream of the throttle valve and generating an intake air flow indicative signal indicative of the detected flow of intake air;

a control unit which derives an intake air flow rate from said intake air flow indicative signal; calculates a product of said derived intake air flow rate and a purge rate; increments a counter by a value proportional to said calculated product; determines a target value of said purge rate out of various values of said purge rate contained in a table in response to said counter, the arrangement being such that, with a predetermined target value of deviation from the stoichiometry, said various values of said purge rate contained in said table are dependent on various values of said counter; and produces a control signal in response to said determined target value; and means for controlling the purge passage in response to said control signal.

According to another aspect of the present invention, there is provided a system for purging a canister containing an absorbent, the canister being connected to a fuel tank to permit thereinto evaporated fuel from the fuel tank to be absorbed by the absorbent, the canister having a purge air inlet and a purge air outlet connected to one end of a purge passage having therein a flow control valve, the purge passage having an opposite end connected to an induction passage of an internal combustion engine at a portion downstream of a throttle valve disposed in the induction passage, the system comprising:

means for accumulating an amount of fuel vapor purged from the canister after the engine starts;

means for storing the accumulated purge fuel vapor amount at least for a predetermined time after the engine stops;

means for detecting a time interval between a time at which the engine stops and a time at which the engine restarts;

means for setting a purge rate characteristic based on the accumulated purge fuel vapor amount stored when the engine starts and the detected time interval, the purge rate characteristic defining, purge rate as a function of accumulated purge fuel vapor amount after the engine starts;

means for calculating a purge rate according to the set purge rate characteristic; and means for adjusting the flow control valve to provide the calculated purge rate.

According to another aspect of the present invention, there is provided a system for purging a canister containing an absorbent, the canister being connected to a fuel tank to permit thereinto evaporated fuel from the fuel tank to be absorbed by the absorbent, the canister having a purge air inlet and a purge air outlet connected to one end of a purge passage having therein a flow control valve, the purge passage having an opposite end connected to an induction passage of an internal combustion engine at a portion downstream of a throttle valve disposed in the induction passage, the system comprising:

means for detecting engine operating conditions; means for calculating a required purge flow rate based on the detected engine operating conditions;

means for controlling the flow control valve based on the detected engine operating conditions and the calculated required purge flow rate;

means for calculating a maximum possible purge flow rate based on the detected engine operating conditions;

means for accumulating a lower one of the required purge flow rate and the maximum possible purge flow rate after the engine starts; and means for correcting the required purge flow rate based on the accumulated purge flow rate.

DETAILED DESCRIPTION OF THE INVENTION

Fuel vapor is purged by air and leaves a canister to be admitted into the engine induction passage through a purge or purging passage. If the air fuel ratio of the purge air or mixture passing through the purge passage is constant, it is possible to keep the rate of purged fuel with respect to intake air admitted to the engine induction passage constant by varying the opening degree of a flow control valve disposed in the purge passage. However, the amount of purged fuel within the purge air varies in response to variation in pressure within the canister, which pressure is variable depending on the amount of fuel vapor absorbed by the absorbent within the canister. Thus, the air fuel ratio of the purge air is rich when there remains a great amount of fuel vapor absorbed by the absorbent. Thus, with the same opening degree of the control valve, the amount of purged fuel admitted into the induction passage increases as the amount of fuel vapor absorbed by the absorbent increases.

According to the present invention, accumulated amount of purge air including fuel vapor during the purging process is calculated. Estimation of the amount of fuel vapor absorbed by the absorbent within the canister can be made based on this accumulated amount of purge air. In view of the estimated amount, the opening degree of the flow control valve is adjusted so that the flow rate of purged fuel into the induction passage is kept at a constant ratio with respect to the flow rate of intake air passing through the induction passage. Stability of air fuel ratio is improved. Since during the purging process, the air fuel ratio is stabilized, the total amount of purge air can be increased.

After the accumulated amount of purge air has exceeded a predetermined large value and thus the fuel vapor remaining in the canister has become sufficiently less, the opening degree of the flow control valve is held at a small degree in Order to prevent supply of excess air to the induction passage since the air fuel ratio of the purge air becomes excessively lean.

Figure 1:
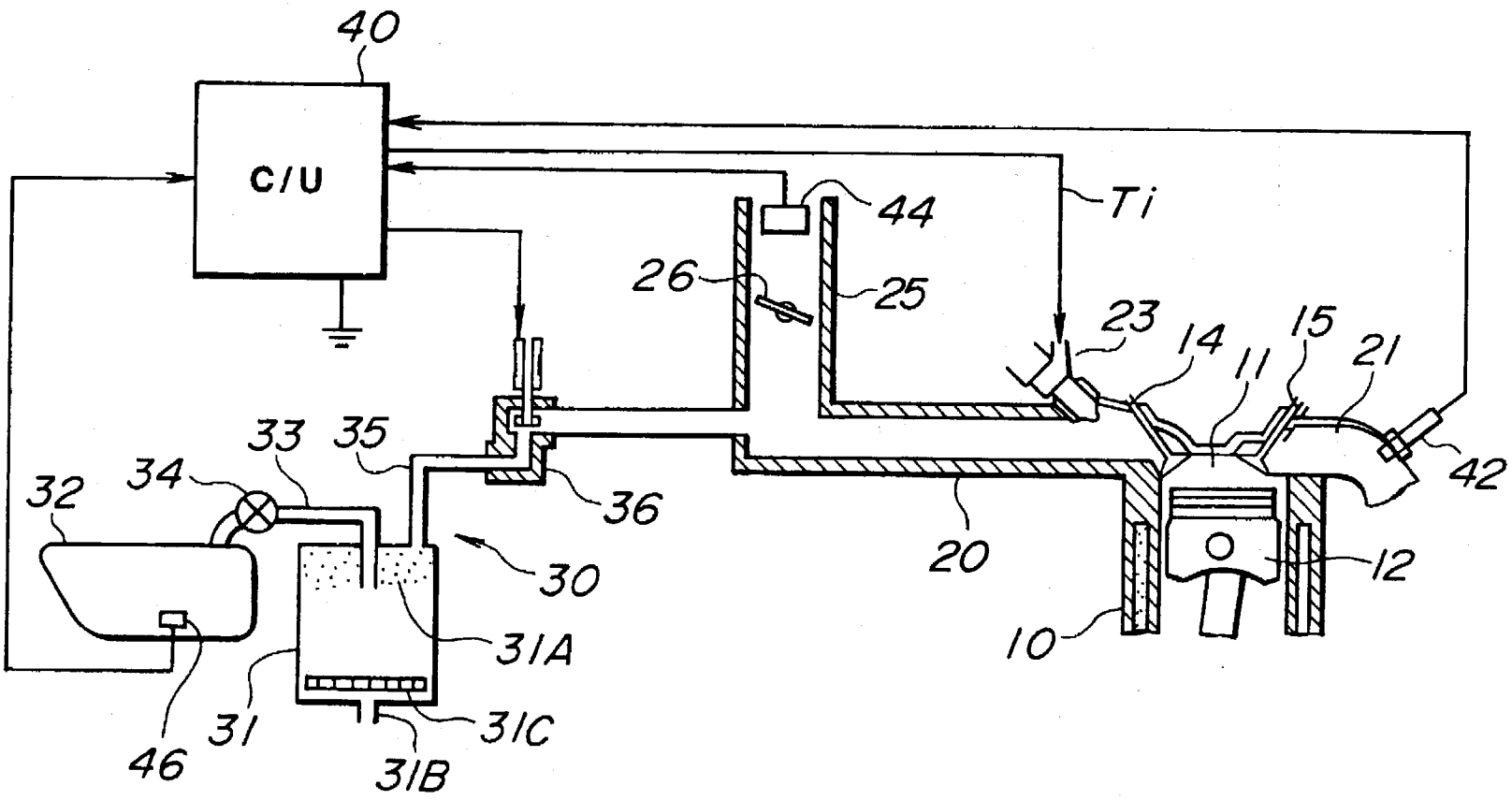
FIG. 1 is a schematic diagram showing a first embodiment of a fuel purging unit made in accordance with the invention.

Referring to the drawings, and in particular to FIG. 1, there is shown an internal combustion engine 10 including combustion chambers or cylinders, one of which is shown at 11. A crankshaft (not shown) is rotatably supported to turn in response to reciprocation of pistons, only one being shown at 12. An intake manifold 20 is connected to each cylinder 11 through an intake port with which an intake valve 14 cooperates for controlling entry of combustible mixture into the cylinder 11. Exhaust gases resulting from the combustion passes through an exhaust port into an exhaust manifold 21. Cooperating with the exhaust port is an exhaust valve 15. The exhaust valve 15 controls discharge of the exhaust gases into the exhaust manifold 21. The intake and exhaust valves are driven via a suitable valve drive gear by the crankshaft. An air induction passage 25 is connected to the intake manifold 20.

A fuel injector 23 is mounted adjacent each cylinder for injecting fuel into the intake manifold 20 toward the adjacent intake valve 14. The fuel injector 23 opens to inject fuel into the intake manifold 20 when it is energized in response to a pulse signal Ti. The pulse width or length of this pulse signal Ti determines the length of time the fuel injector 23 opens, and thus determines the amount of fuel injected into the intake manifold 20. Intake air to the engine is admitted to the induction passage 25 through an air cleaner (not shown). The flow rate $Q_{IA}$ of the intake air admitted into the induction passage 25 and then into the intake manifold 20 is controlled by a throttle valve 26 disposed in the induction passage 25.

Mounted to the exhaust manifold 21 is an oxygen sensor 42 which detects oxygen concentration within the exhaust gases and generates a voltage signal. An air flow meter 44 is disposed within the induction passage 25 at a portion upstream of the throttle valve 26 to detect the flow rate $Q_{IA}$ of intake air admitted into the induction passage 25 and generates a signa indicative of the detected intake air flow rate $Q_{IA}$. The output signals of the air flow meter 42 and oxygen sensor 40 are fed to a control unit 40. Based on these signals and other information, a closed or feedback control air fuel ratio is effected in the conventional manner to determine the pulse width of the pulse signal Ti on which the fuel injector 23 operates.

The engine 10 is associated with an evaporated fuel purging unit, generally designated by the reference numeral 30. The evaporated fuel purging unit includes a canister 31 containing an absorbent 31A, such as activated charcoal. The canister 31 is connected to a fuel tank 32 through an evaporated fuel passage 33 to permit thereinto evaporated fuel from the fuel tank 32 to be absorbed by the absorbent 31A. The evaporated fuel passage 33 has a check valve 34 which permits the evaporated fuel from the fuel tank 32 to the canister 31 when the evaporated fuel pressure exceeds a predetermined value while preventing backflow. For purging fuel vapor absorbed by the absorbent 31A, the canister has a purge or purging air inlet 31B and a purge or purging air outlet connected to one end of a purge or purging passage 35. At the opposite end, the purge passage 35 is connected to the induction passage 25 at a portion downstream of the throttle valve 26. A solenoid operated control valve 35 is disposed in the purge passage 35. The canister 31 has a filter 31C adjacent the purge air inlet 31B. A temperature sensor 46 is disposed in the fuel tank 32 to detect the temperature signal indicative of the detected fuel temperature. This signal is fed to the control unit 40.

The solenoid operated flow control valve 36 is controlled by the control unit 40. The duty (DUTY) of the flow control valve 36 is determined by the control unit 40 and the flow control valve 36 varies its opening degree and thus the flow cross sectional area of the purge passage 35 in response to the determined duty by the control unit 40.

Figure 2:
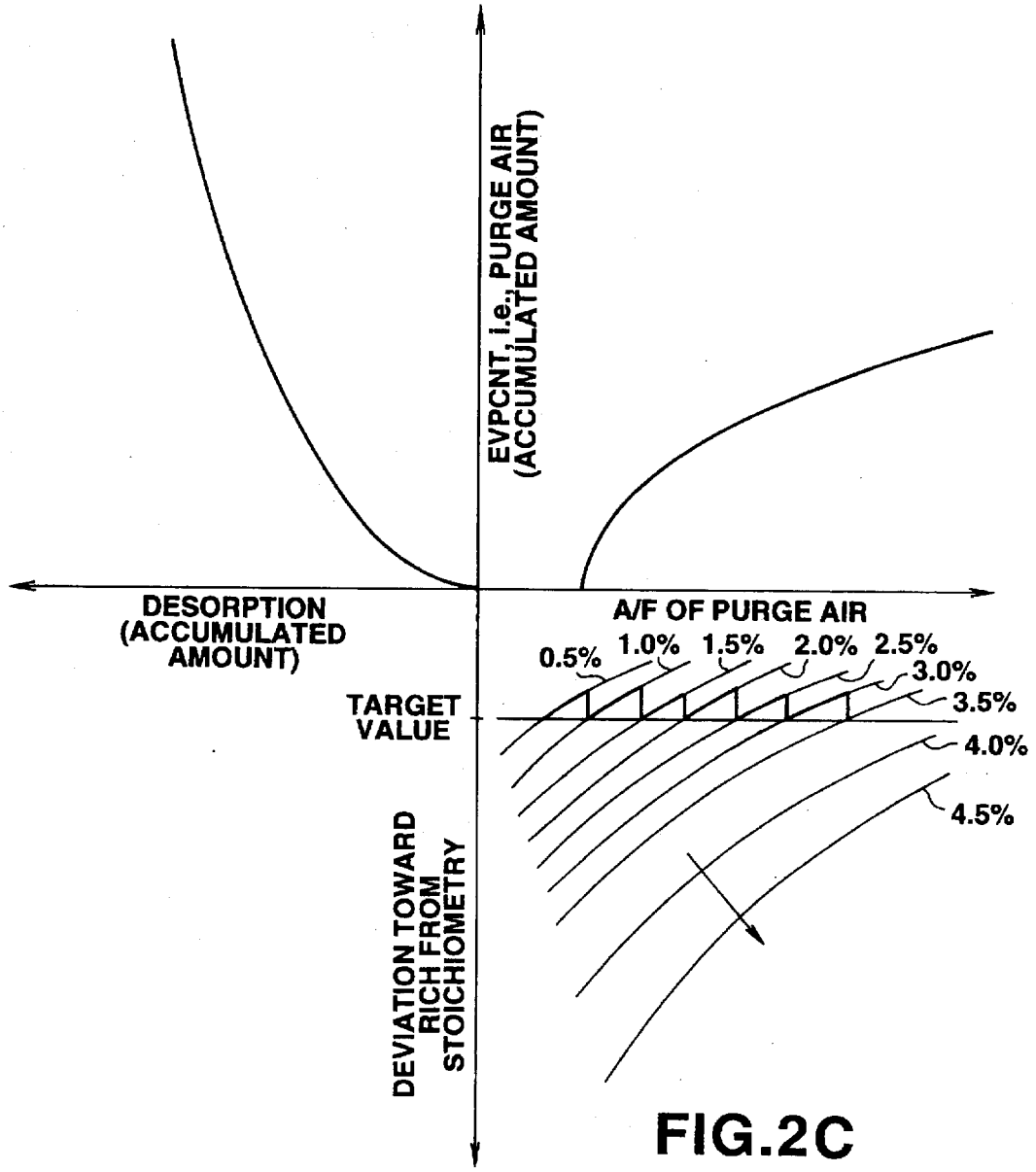
FIG. 2 is a combined view of FIGS. 2A, 2B and 2C.

Referring to FIG. 2, FIG. 2A shows a desorption characteristic curve of the canister 31. The vertical axis of FIG. 2A shows accumulated amount of purge air, the accumulated amount being expressed by an evaporation counter (EVPCNT). This accumulated amount increases as the purging proceeds. The horizontal axis of FIG. 2A shows the accumulated amount of fuel vapor owing to desorption. At the initial stage of the purging process, since the amount of fuel vapor remaining in the canister 31 is substantially great and thus the evaporated fuel pressure therein is high, the amount of evaporated fuel within the purge air passing through the purge passage 35 is great. Thus, an increase in absorbent (accumulated amount) with respect to an unit increase in purge air (accumulated amount) is large. As the purging process proceeds further, since the remaining amount of fuel vapor in the canister 31 becomes less, the increase in desorption (accumulated amount) becomes small.

FIG. 2B shows a variation characteristic of an air fuel ratio of the purge air, i.e., a purge air A/F, which corresponds to the desorption characteristic of the canister 31. In FIG. 2B, the vertical axis is common to the vertical axis of the FIG. 2A, while the horizontal axis shows A/F of purge air. From FIG. 2B, it is readily seen that, the purge air A/F increases becomes lean as the purging process proceeds.

FIG. 2C shows the influence on the closed loop or feedback control of air fuel ratio by variation in the purge air A/F as the purging process proceeds. The horizontal axis is common to FIG. 2C and FIG. 2B. The vertical axis of FIG. 2C shows a deviation toward rich from stoichiometry. On this vertical axis, a target value of the deviation according to the control is indicated. In FIG. 2C, the influence on the deviation by the purge air A/F is expressed using purge rate as a parameter. The purge rate is expressed as:

$$PR=(Q_{PA}/Q_{IA})\times 100$$

where PR is the purge rate, $Q_{PA}$ is the flow rate of purge air and $Q_{IA}$ is the flow rate of intake air.

From FIG. 2C, it is seen that the deviation becomes less as the purge air A/F becomes lean. This means the influence on the deviation becomes less as the purge air A/F becomes great or lean. It is noted that in order to keep the deviation constant, the purge rate should be increased in response to increase in the purge air A/F, which increase is related to EVFCNT which is expressed as:

$$EVPCNT=Q_{IA}\times PG\times KDUTY$$

where $Q_{IA}$ is the flow rate of intake air, PG is the purge rate and KDUTY is a constant.

Figure 3:
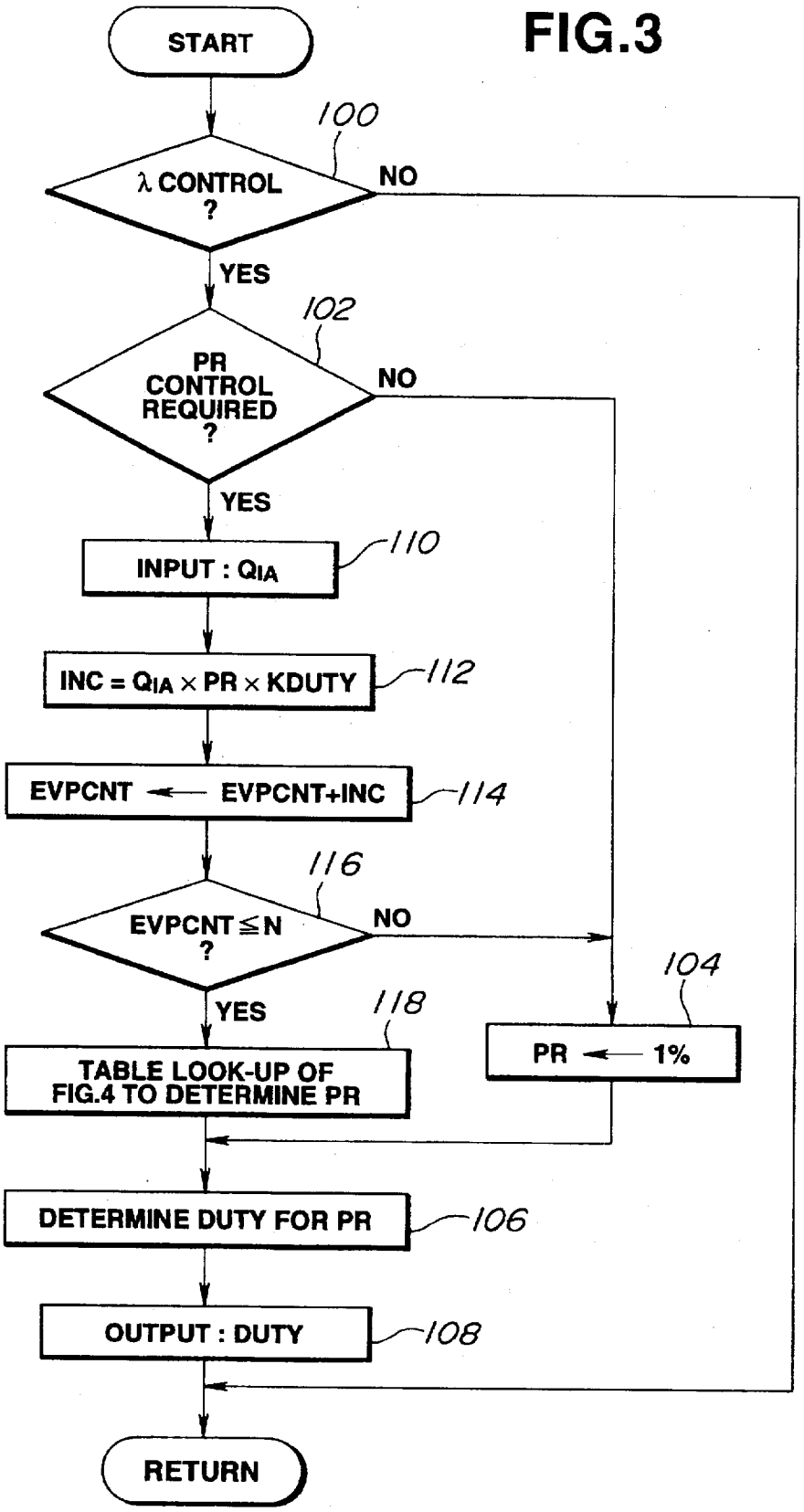
FIG. 3 is a flow chart.
Figure 4:
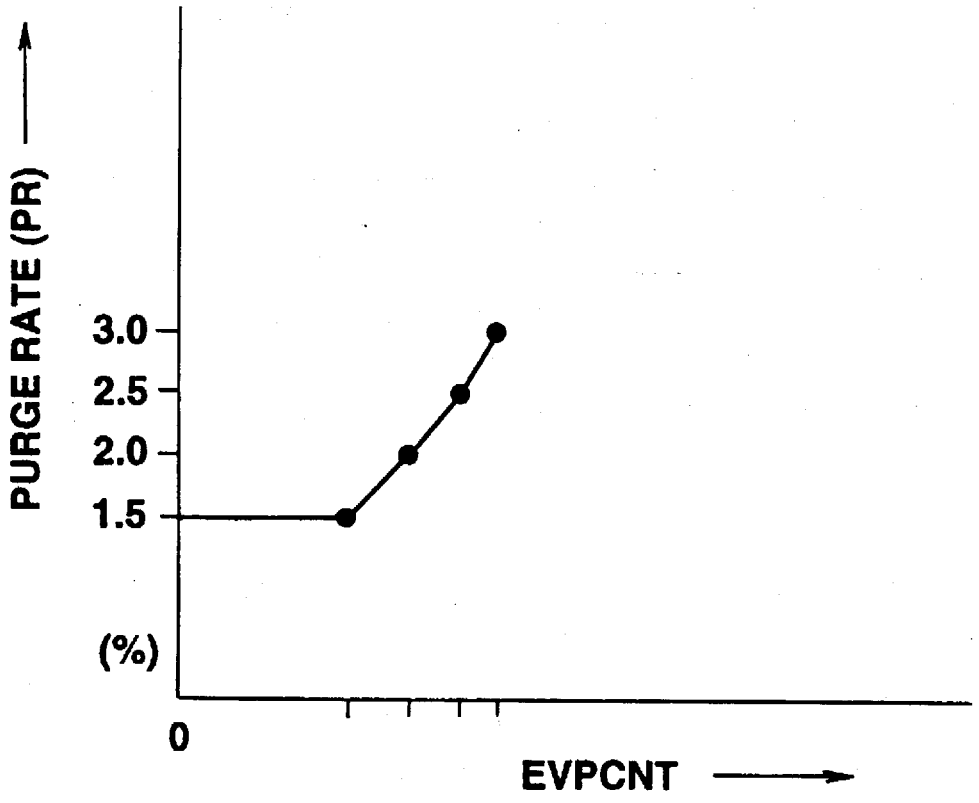
FIG. 4 is a graphical representation of a table.

Referring to FIGS. 3 and 4, FIG. 4 is a graphical representation of a table which is derived from FIG. 2. In FIG. 4, the horizontal axis shows EVPCNT, while the vertical axis shows purge rate. For accomplishing the target value of the deviation (see FIG. 2C), the purge rate starts with 1.5% unit EVPCNT increases upto a first value (the initial stage of purging process), and it increases to 2.0%, 2.5%, 3.0% . . . until EVPCNT increases a great value N.

The flow chart of FIG. 3 is explained. This control is repeated at regular intervals. At a step 100, it is determined whether the feedback control of air fuel ratio based on the output of the oxygen sensor 42 is being carried out or not. If this is not the case, the control proceeds to the start point. If the answer to this question is "yes", the control proceeds to a step 102 where it is determined whether or not the purge rate (PR) control is required. What is done at this step 102 is to check the fuel temperature detected by the temperature sensor 46. The interrogation is such that whether the fuel temperature falls in a predetermined range of temperature. For example, the lower limit of this temperature range is 47° C. and the upper limit is 68° C. If the temperature falls outside of this temperature range, the control proceeds from this step 102 to a step 104. At the step 104, the purge rate (PR) is fixed at a small value of 1.0%. Following this step 104, the control proceeds to a step 106 where the duty (DUTY) for PR of 1.0% is determined. Then, the determined DUTY is output at a step 108. The solenoid operated flow control valve 36 operates on this determined DUTY to condition its opening degree to give the purge rate determined at the step 104.

If the answer to this question at the step 102 is "yes", the control proceeds to a step 110 where the flow rate of intake air $Q_{IA}$ is input from the output of the air flow sensor 44. Then, the control proceeds to steps 112 and 114 to calculate EVPCNT. At the step 112, an increment INC is given by the following equation:

$$INC=Q_{IA}\times PR\times KDUTY$$

where INC is the increment, $Q_{IA}$ is the flow rate of intake air, and PR is the purge rate. At the subsequent step 114, EVPCNT is incremented by INC just determined.

After this step 114, the control proceeds to a step 116 where it is determined whether or not EVPCNT is less than or equal to the predetermined large value N. If the EVPCNT is greater than this value N, the control proceeds to the step 104 to fix the purge rate (PR) to the small value of 1.0%. If the EVPCNT is less than or equal to the value N, the control proceeds to a step 118 where a table look-up operation of FIG. 4 is performed based on the EVPCNT to determine the purge rate (PR). After this step 118, the control proceeds to the steps 106 and 108 to output the duty (DUTY) for the determined PR at the step 118. In response to this DUTY, the solenoid operated control valve 36 conditions its opening degree to give the purge rate determined at the step 118.

From the preceding description, it will now be appreciated that the deviation from the stoichiometry is kept at the target value against the disturbance by the purging of fuel vapor into the induction passage 25.

Figure 5:
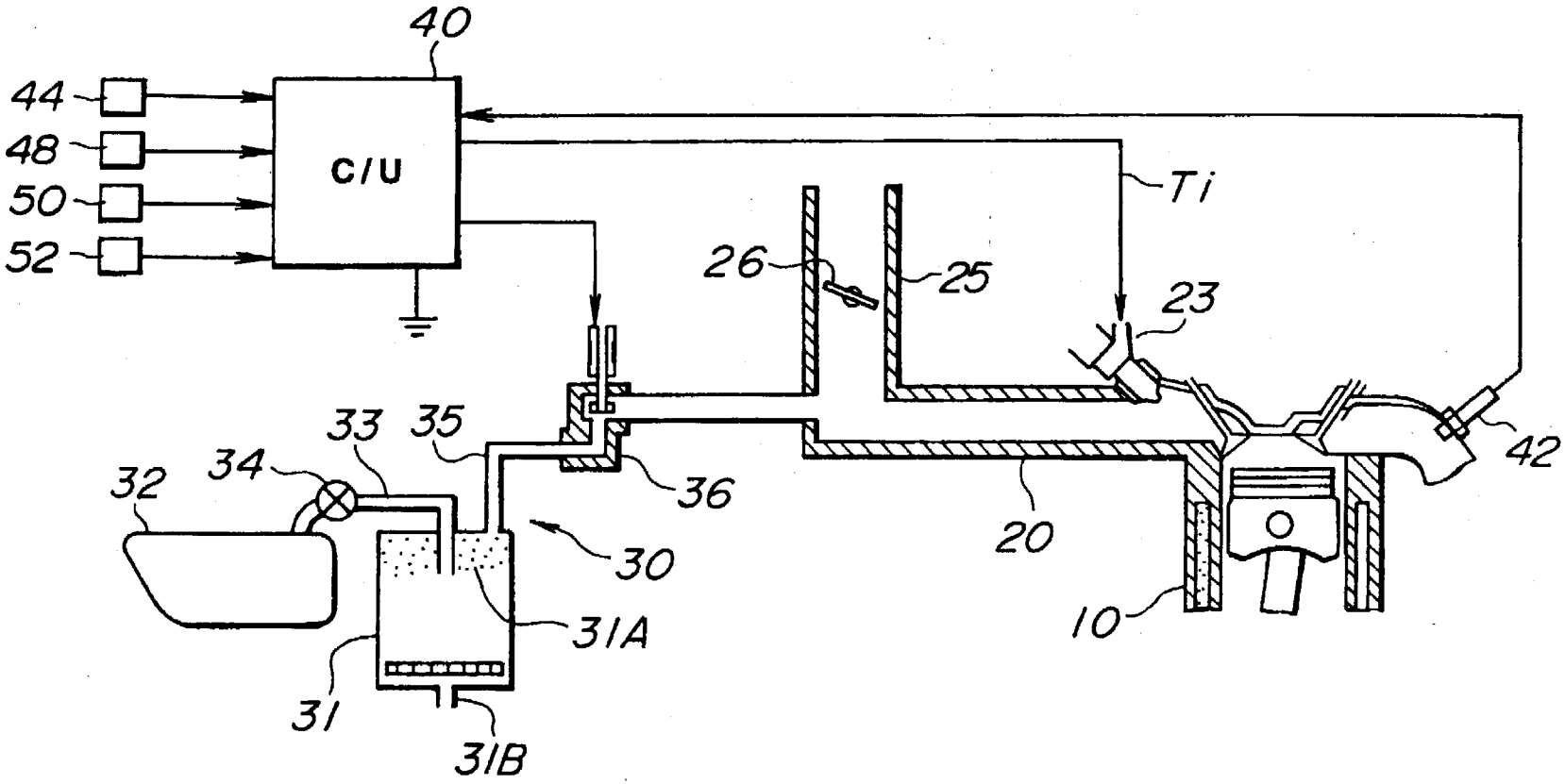
FIG. 5 is a schematic diagram showing a second embodiment of the fuel purging unit of the invention.

Referring to FIG. 5, there is shown a second embodiment of the invention. In this embodiment, the control unit 40 receives inputs from various sensors for controlling the fuel injector 23 and the flow control valve 36. The sensors include an oxygen sensor 42, an airflow meter 44, an engine speed sensor 48, and an engine coolant temperature sensor 50. The engine speed sensor 48 produces a signal indicative of the speed N of rotation of the engine 10. The engine coolant temperature sensor 50 is provided to produce a signal indicative of the temperature TWN of the engine coolant. The control unit 40 also receives an ON/OFF signal from an ignition switch 52.

Figure 6:
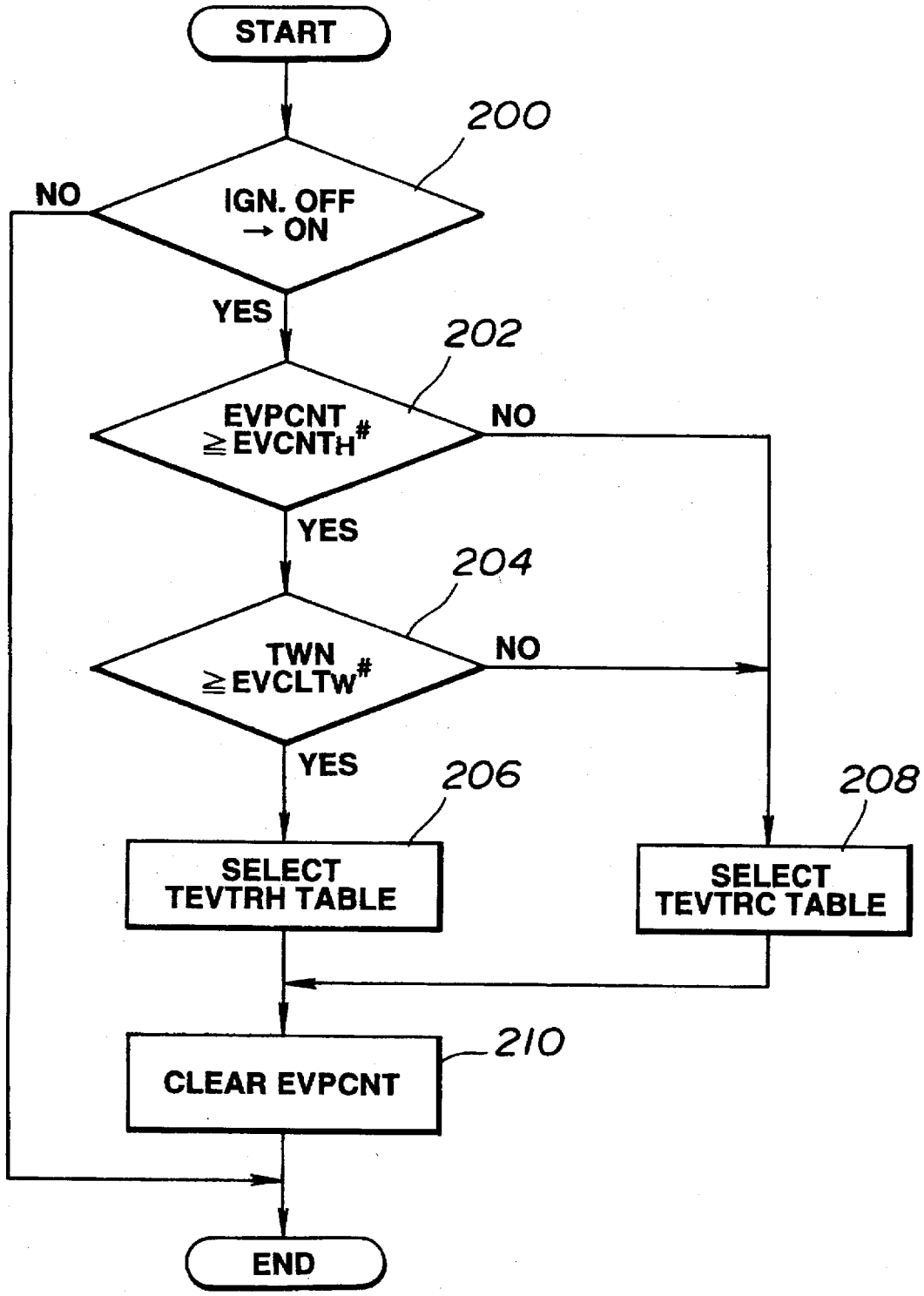
FIG. 6 is a flow chart.

FIG. 6 is a flow chart showing the programming of the digital computer as it is used to select one of TEVTRH and TEVTRC tables which defines a desired purge rate with the amount EVPCNT of purge air accumulated (after) the engine starts. This program is repeated at regular intervals. At the step 200, a determination is made as to whether or not the ignition switch 52 changes from its OFF position to its ON position. If the answer to this question is "yes", then it means that the engine is starting and the program proceeds to the step 202. Otherwise, the program proceeds to the end point. At the step 202, another determination is made as to whether or not the accumulated purge air amount value EVPCNT obtained during the last engine operation is equal to or greater than a predetermined value EVCLTH#. The accumulated purge air amount value EVPCNT was stored when the engine came to a stop, that is, at the end of the last engine operation. If the accumulated purge air amount value EVPCNT is equal to or greater than a predetermined small value≧EVCNTH#, then it means that the amount of fuel residual in the canister 32 is small and the program proceeds to the step 204. Otherwise, the program proceeds to the step 208.

Figure 7:
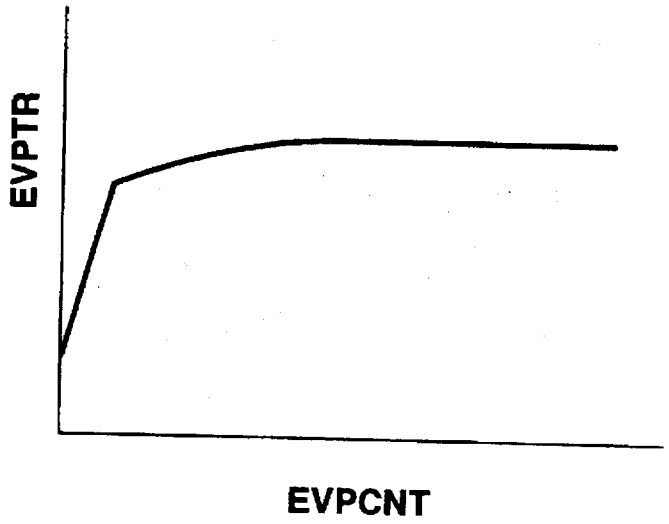
FIG. 7 is a graph of purge rate versus accumulated purge air amount.
Figure 8:
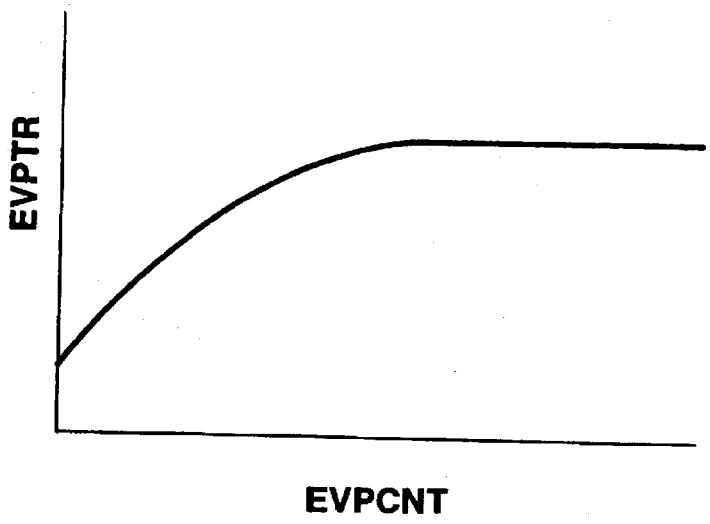
FIG. 8 is a graph of purge rate versus accumulated purge air amount.
Figure 9:
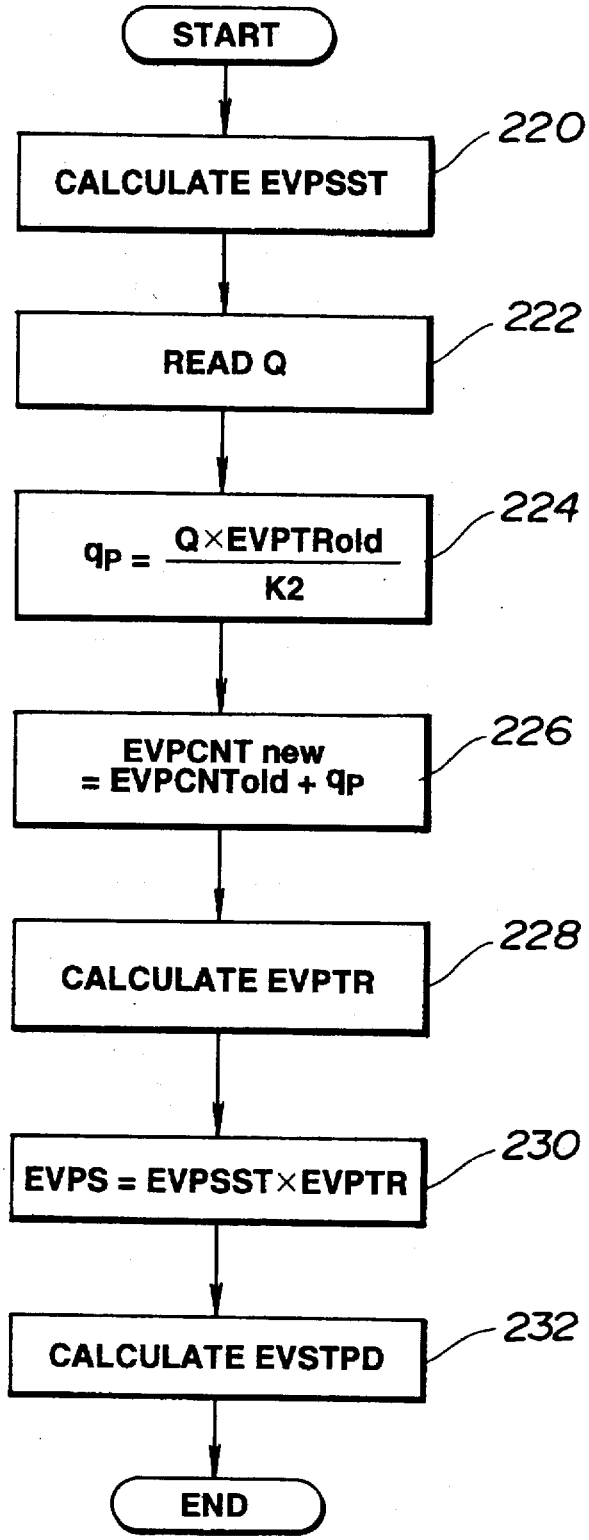
FIG. 9 is a flow chart.

At the step 204, a determination is made as to whether or not the engine coolant temperature TWN is equal to or greater than a predetermined value EVCNTW#. If the answer to this question is "yes", then it means that the engine is so warm as to permit hot restart. In other words, the time elapsed after the engine came to the stop is short and the amount of fuel vapor absorbed by the absorbent 31A is small. In this case, the program proceeds to the step 206 where the TEVTRH table is selected. The selected TEVTRH table defines the purge rate EVPTR as a function of accumulated purge air amount value EVPCNT, as shown in FIG. 7, for small amounts of fuel vapor absorbed by the absorbent 31A. Following this, the ,program proceeds to the step 210. If TWN<$EVCLT_W$#, then the program proceeds from the step 204 to the step 208 where the TEVTRC table is selected. The selected TEVTRC table defines the purge rate EVPTR as a function of accumulated purge air amount value EVPCNT, as shown in FIG. 8, for great amounts of fuel vapor absorbed by the absorbent 31A. It can be seen from a comparison of FIGS. 7 and 8, the purge rate increases at a greater rate after engine starting for the ETVTRH table than for the ETVTRC table. Following this, the program proceeds to the step 210 where the count (EVPCNT), which indicates the accumulated purge air amount value, is cleared to zero.

FIG. 8 is a flow chart showing the programming of the digital computer as it is used for purge rate control. This program is repeated at regular intervals. At the step 220, the standard flow cross sectional area index EVPSST of the flow control valve 36 from a map table programmed into the computer. This map table defines the index EVPSST as a function of engine speed N and basic value Tp for fuel delivery requirement. The index EVPSST is used to correct the flow cross sectional area in a manner to achieve the same purge mixture flow rate according to intake negative pressure on which the purge mixture flow rate depends.

At the step 222, the intake air flow Q, which is sensed by the airflow meter 44, is read into the computer memory. At the step 224, the required purge flow rate $q_p$ is calculated as:

$$q_p = Q \cdot EVPTR_{OLD}/K2$$

where $EVPTR_{OLD}$ is the purge rate calculated, during the last cycle of execution of the program, from the map table selected in the program shown in FIG. 6, and K2 is a constant. The required amount of fuel vapor may be set at a value proportional to the intake air flow Q in order to maintain a constant air/fuel ratio. Since the fuel vapor percentage in the purge mixture depends on the amount of fuel residual in the canister 31, however, the purge rate is set at a smaller value at a greater fuel vapor percentage to obtain a desired fuel vapor flow rate regardless of fuel vapor percentages.

At the step 226, the required purge flow rate $q_p$ is added to the last accumulated purge air amount value $EVPCNT_{OLD}$ to calculate an updated or new accumulated purge air amount value $EVPCNT_{NEW}$. The required purge flow rate may be replaced with the accumulated value of fuel vapor flow rate Q/K2. At the step 228, a new purge rate $EVPTR_{NEW}$ is calculated as a function of the new accumulated purge air amount value $EVPCNT_{NEW}$. At the step 230, the target value for the flow cross sectional index EVPS of the flow control valve 36 is calculated as:

$$EVPS = EVPSST \cdot EVPTR_{NEW}$$

At the step 232, the duty ratio EVSTPD is calculated from a map table which defines it as a function of the target flow cross sectional index value EVPS of the flow control valve 36. The calculated duty ratio is converted into a control signal which is applied to operate the flow control valve 36 at the calculated duty ratio.

In this embodiment, the amount of fuel vapor absorbed in the canister 31 during the interval between the time at which the engine stops and the time at which the engine restarts is estimated based on the engine coolant temperature sensed when the engine restarts. The control units 40 can estimate the amount of fuel vapor absorbed in the canister 31 before the engine starts by adding the accumulated purge fuel vapor amount value stored at the end of the last engine operation, that is, the amount of fuel residual in the canister 31 to the estimated amount of fuel vapor absorbed in the canister 31 before the engine restarts. The desired purge rate is calculated from one of map tables selected according to whether the amount of fuel vapor absorbed in the canister 31 before the engine restarts is small or great. It is possible, therefore, to control the purge rate in a manner to achieve a constant air/fuel ratio regardless of engine starting conditions.

Figure 10:
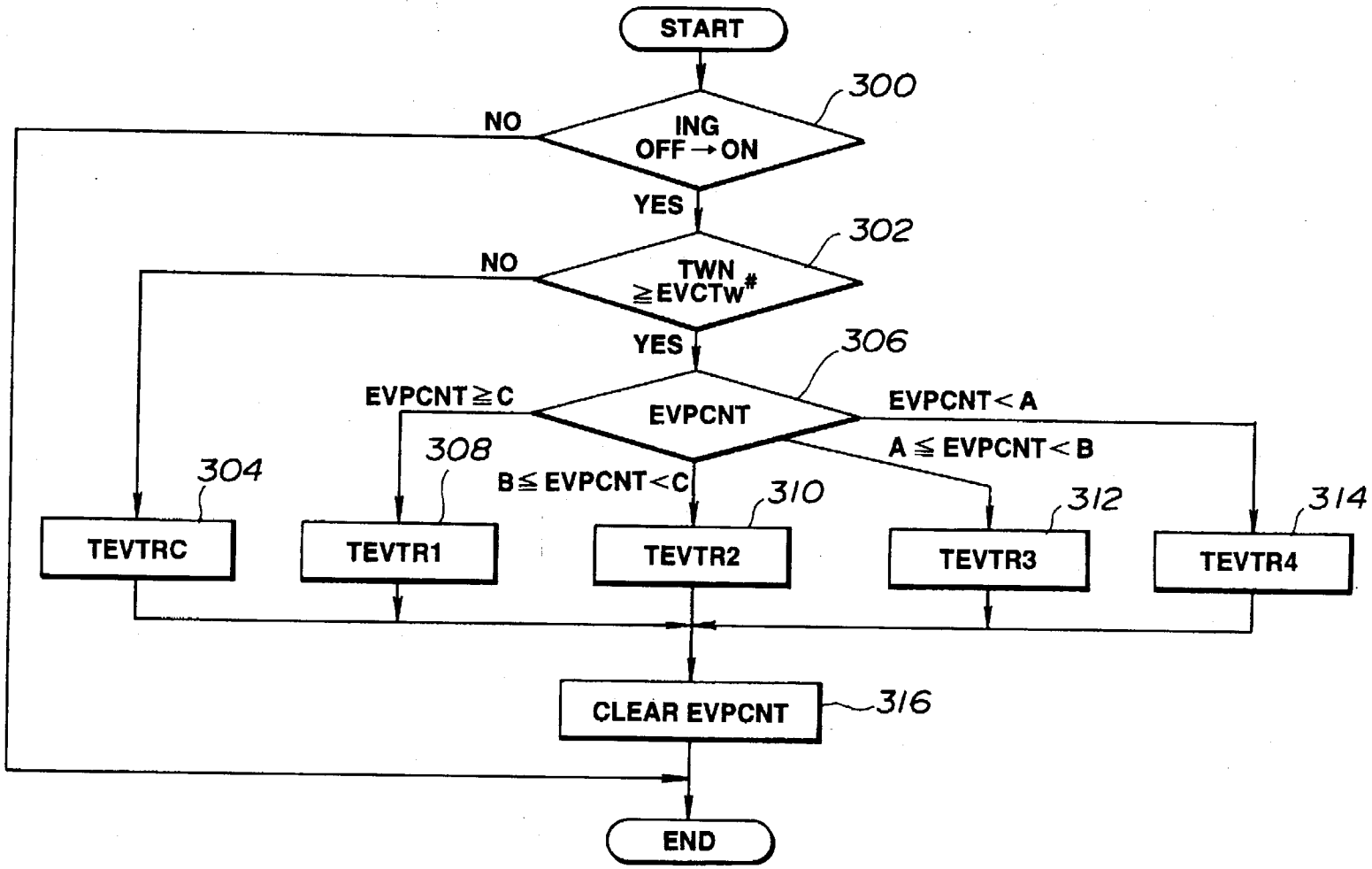
FIG. 10 is a flow chart.

FIG. 10 is a flow chart showing a modified form of the programming of the digital computer as it is used to select one of various map tables in calculating the purge rate. At the step 300, a determination is made as to whether or not the ignition switch 52 changes from its OFF position to its ON position. If the answer to this question is "yes", then it means that the engine is starting and the program proceeds to the step 302. Otherwise, the program proceeds to the end point. At the step 302, another determination is made as to whether or not the engine coolant temperature TWN is equal to or greater than a predetermined value $EVCNT_W$#. If the answer to this question is "yes", then the program proceeds to the step 306. If TWN<$EVCLT_W$#, then the program proceeds from the step 302 to the step 304 where the TEVTRC table is selected.

At the step 306, a determination is made for the accumulated purge air amount value EVPCNT obtained during the last engine operation. If the accumulated purge air amount value EVPCNT is equal to or greater than a predetermined value C, then the program proceeds to the step 308 where a TEVTR1 table is selected. If the accumulated purge air amount value EVPCNT is less than the predetermined value C and equal to or greater than a predetermined value B smaller than the predetermined value C, then the program proceeds to the step 310 where a TEVTR2 table is selected. If the accumulated purge air amount value EVPCNT is less than the predetermined value B and equal to or greater than a predetermined value A smaller than the predetermined value B, then the program proceeds to the step 312 where a TEVTR3 table is selected. If the accumulated purge air amount value EVPCNT is less than the predetermined value A, then the program proceeds to the step 314 where a TEVTR4 table is selected. Following this, the program proceeds to the step 210. If TWN<$EVCLT_W$#, then the program proceeds from the step 204 to the step 208 where the TEVTRC table is selected. The TEVTRC, TEVTR1, TEVTR2, TEVTR3 and TEVTR4 tables define the purge rate EVPTR as a function of accumulated purge air amount value EVPCNT for absorbed fuel vapor amounts increasing in this order. The purge rate increases at a greater rate after engine starting for the ETVTR4 table than for the ETVTR3 table. The purge rate increases at a greater rate after engine starting for the ETVTR3 table than for the ETVTR2 table. Similarly, the purge rate increases at a greater rate after engine starting for the ETVTR2 table than for the ETVTR1 table. Likewise, the purge rate increases at a greater rate after engine starting for the ETVTR1 table than for the ETVTRC table. At the step 316, the count (EVPCNT), which indicates the accumulated purge air amount value, is cleared to zero.

Figure 11:
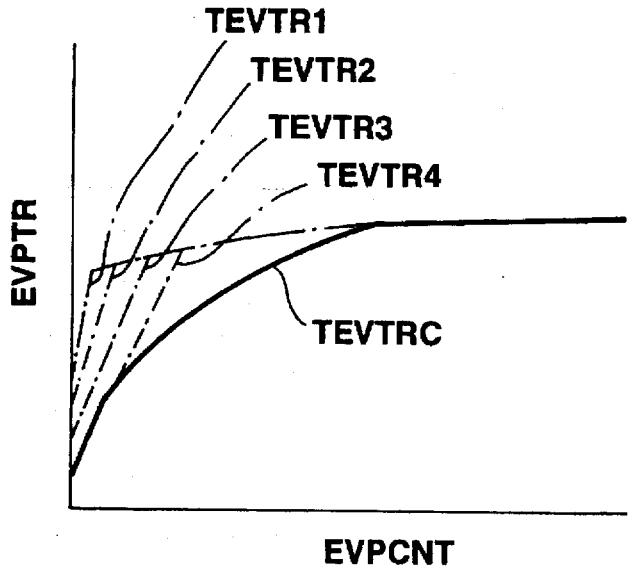
FIG. 11 is a graph of purge rate versus accumulated purge air amount.

The desired purge rate is calculated from one of various map tables selected according to whether the amount of fuel vapor absorbed in the canister 31 before the engine restarts is small or great. This modification can provide finer purge rate control than the first embodiment. The initial purge rate and/or the rate at which the purge rate increases is smaller when the accumulated purge air amount value EVPCNT is greater and the initial residual fuel amount is smaller, as shown in FIG. 11. It is possible, therefore, to control the purge rate in a manner to achieve a constant air/fuel ratio regardless of engine starting conditions.

Although the amount of fuel vapor absorbed in the canister 31 during the interval between the time at which the engine stops and the time at which the engine restarts is estimated based on the engine coolant temperature sensed when the engine restarts, it is to be noted that the time interval may be measured with the use of a timer.

Figure 12:
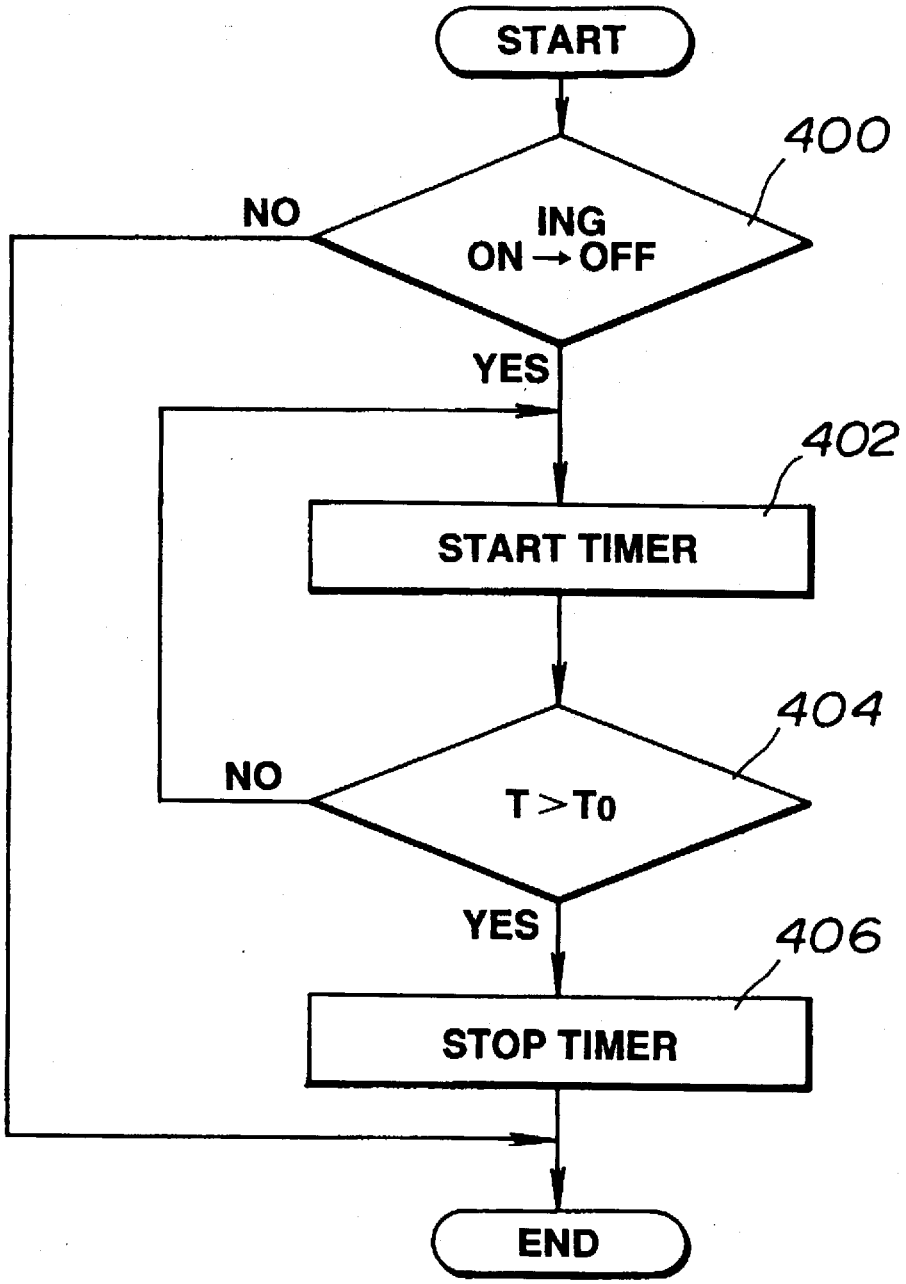
FIG. 12 is a flow chart.

FIG. 12 is a flow chart showing the programming of the digital computer as it is used to measure the interval between the time at which the engine stops and the time at which the engine restarts. At the step 400, a determination is made as to whether or not the ignition switch 52 changes from its ON position to its OFF position. If the answer to this question is "yes", then it means that the engine stops and the program proceeds to the step 402. Otherwise, the program proceeds to the end point. At the step 402, the timer is started. At the step 404, a determination is made as to whether or not the count T of the timer is greater than a predetermined value To. If the answer to this question is "yes", then the program proceeds to the step 406 where the timer is stopped. Otherwise, the program is returned to the step 402.

Figure 13:
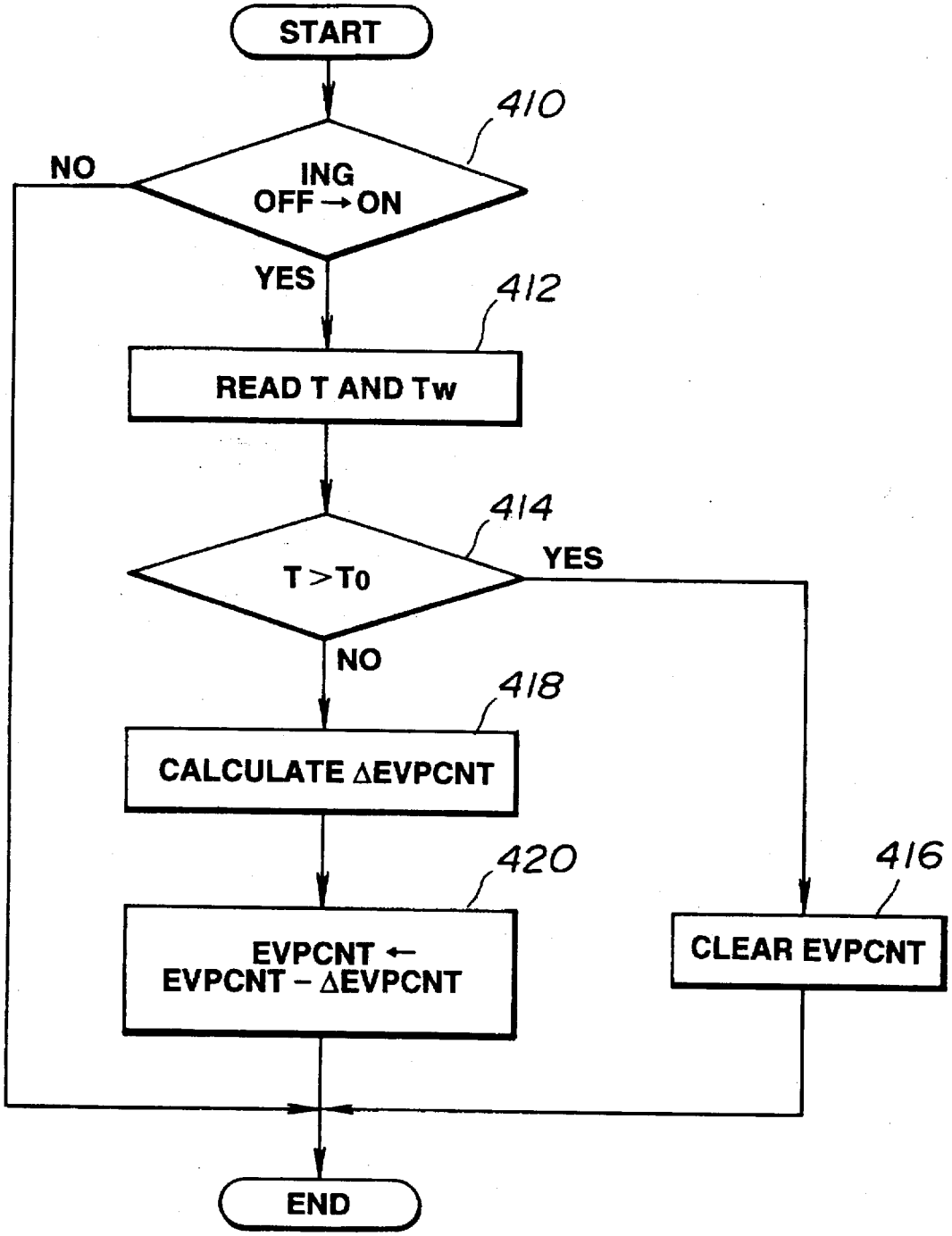
FIG. 13 is a flow charts.
Figures 15A, 15B, 15C, 15D, 15E:
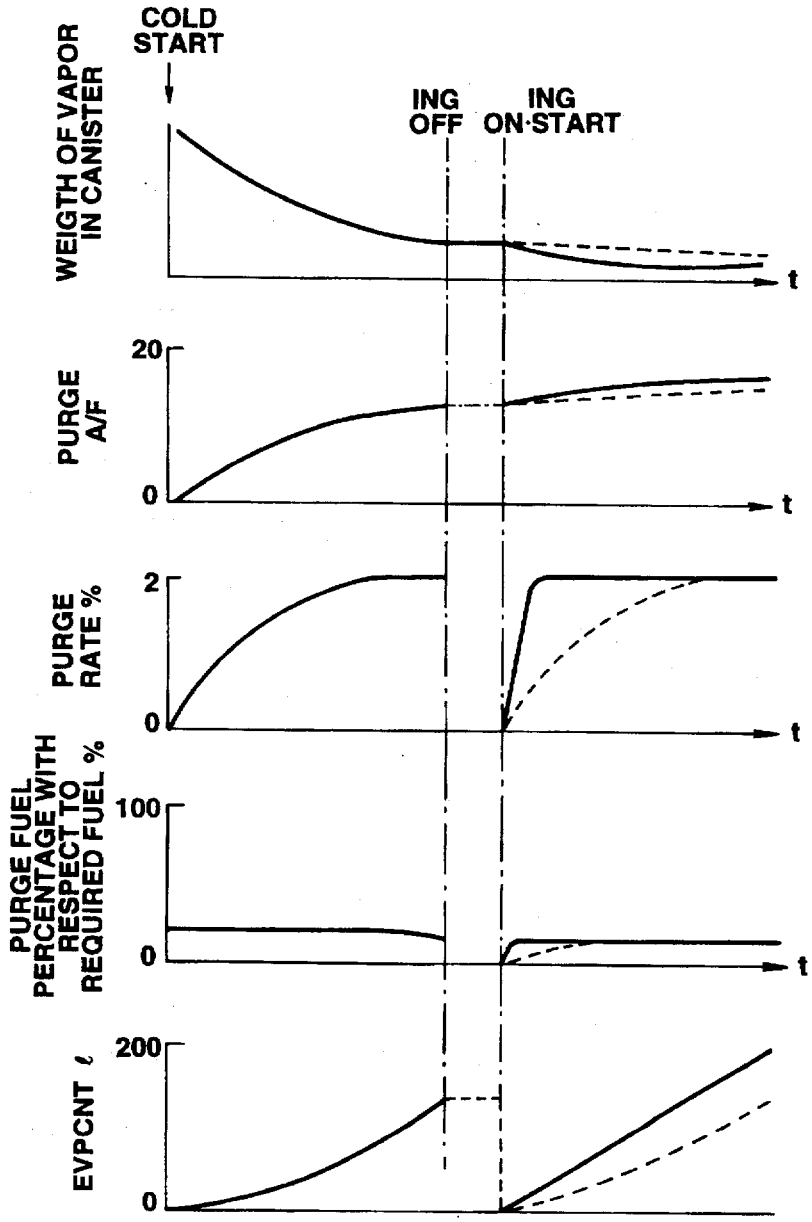
FIGS. 15A to 15E are graphs showing variations in various parameters with time.

FIG. 13 is a flow chart showing the programming of the digital computer as it is used to set the purge rate when the engine restarts. At the step 410, a determination is made as to whether or not the ignition switch 52 changes from its OFF position to its ON position. If the answer to this question is "yes", then it means that the engine starts and the program proceeds to the step 412. Otherwise, the program proceeds to the end point. At the step 412, the count T of the timer and the engine coolant temperature Tw are read into the computer memory. The engine coolant temperature Tw is sensed by the temperature sensor 50 when the engine restarts. At the step 414, a determination is made as to whether or not the count T of the timer is greater than the predetermined value To. If the answer to this question is "yes", then it means that the canister 31 is charged with fuel vapor while the engine is at rest and the program proceeds to the step 420 where the accumulated purge air amount value EVPCNT is cleared to zero. In this case, the normal map table TEVTRC is used to calculate the purge rate according to the amount EVPCNT of the purge air accumulated after the engine restarts. If the count T of the timer is equal to or less than the predetermined value To, then the program proceeds from the step 414 to the step 418.

Figure 14:
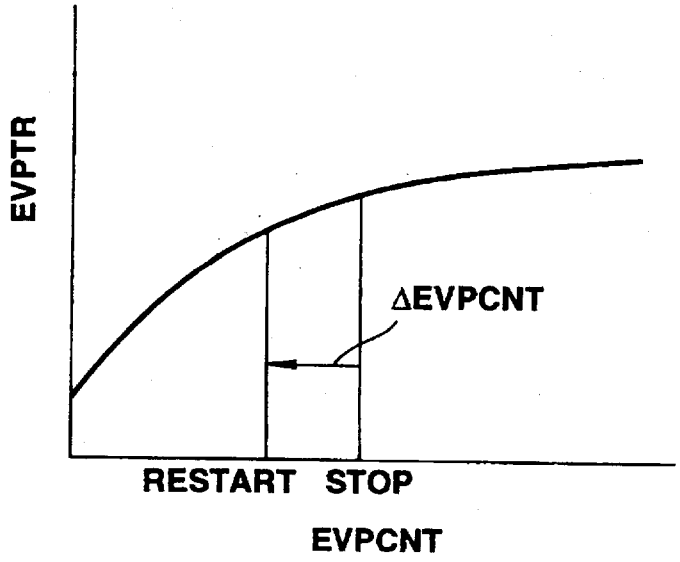
FIG. 14 is a graph of purge rate versus accumulated purge air amount.

At the step 418, the correction factor ΔEVPCNT by which the accumulated purge air amount value EVPCNT is to be corrected is calculated as a function of the elapsed time T (indicated by the count T of the timer) and the engine coolant temperature Tw. The correction factor ΔEVPCNT is used to compensate for the change in the amount of fuel vapor absorbed in the canister 31 from the time at which the engine 10 stops to the time at which the engine 10 starts. Since the amount of fuel vapor absorbed in the canister 31 increases as the elapsed time T increases and as the engine coolant temperature Tw increases, it is required to decrease the accumulated purge air amount value EVPCNT. For this reason, at the step 420, the initial value of the accumulated purge air amount value EVPCNT at engine starting is calculated by subtracting the correction factor ΔEVPCNT from the accumulated purge air amount value EVPCNT obtained when the engine stops, as shown in FIG. 14.

The purge rate corresponding to the accumulated purge air amount value EVPCNT after the engine starts is set with the use of the normal map table TEVTRC. In this case, the accumulation of the purge air is started from its initial value, that is, the corrected value calculated at the step 420.

In this embodiment, the purge rate control accuracy can be improved with the use of only one normal map table. However, a plurality of map tables may be used selectively for the purge rate control. In this case, one of the map tables may be selected based on the elapsed time T and the engine coolant temperature Tw as described in connection with the first embodiment.

FIGS. 15A to 15E are graphs showing comparative parameter variations after the engine restarts. The solid curves relate to the present invention and the broken curves relate to the conventional apparatus. It can be seen that the air/fuel ratio can be stabilized by increasing the purge rate at a greater rate when the engine restarts in a shorter time after the engine stops.

In this embodiment, the total amount of fuel vapor residual in the canister when the engine restarts can be derived with high accuracy based on the amount of purge fuel vapor accumulated until the last engine operation and the interval between the time at which the engine stops and the time at which the engine restarts. This is effective to increase the accuracy with which the purge rate control is performed. It means that a small amount of fuel vapor remains in the canister when a great amount of purge fuel vapor is accumulated when the engine stops and/or when the time interval is short. In this case, thus, the purge rate control may be made to increase the purge rate at a greater rate from its initial value used just when the engine restarts. It is preferable to improve the purging efficiency by increasing the initial value of the purge rate as the accumulated purge fuel vapor value increases. The engine coolant temperature remains at a higher temperature for a shorter interval between the time at which the engine stops and the time at which the engine restarts. Thus, the engine coolant temperature can be used to represent this time interval.

Figure 16:
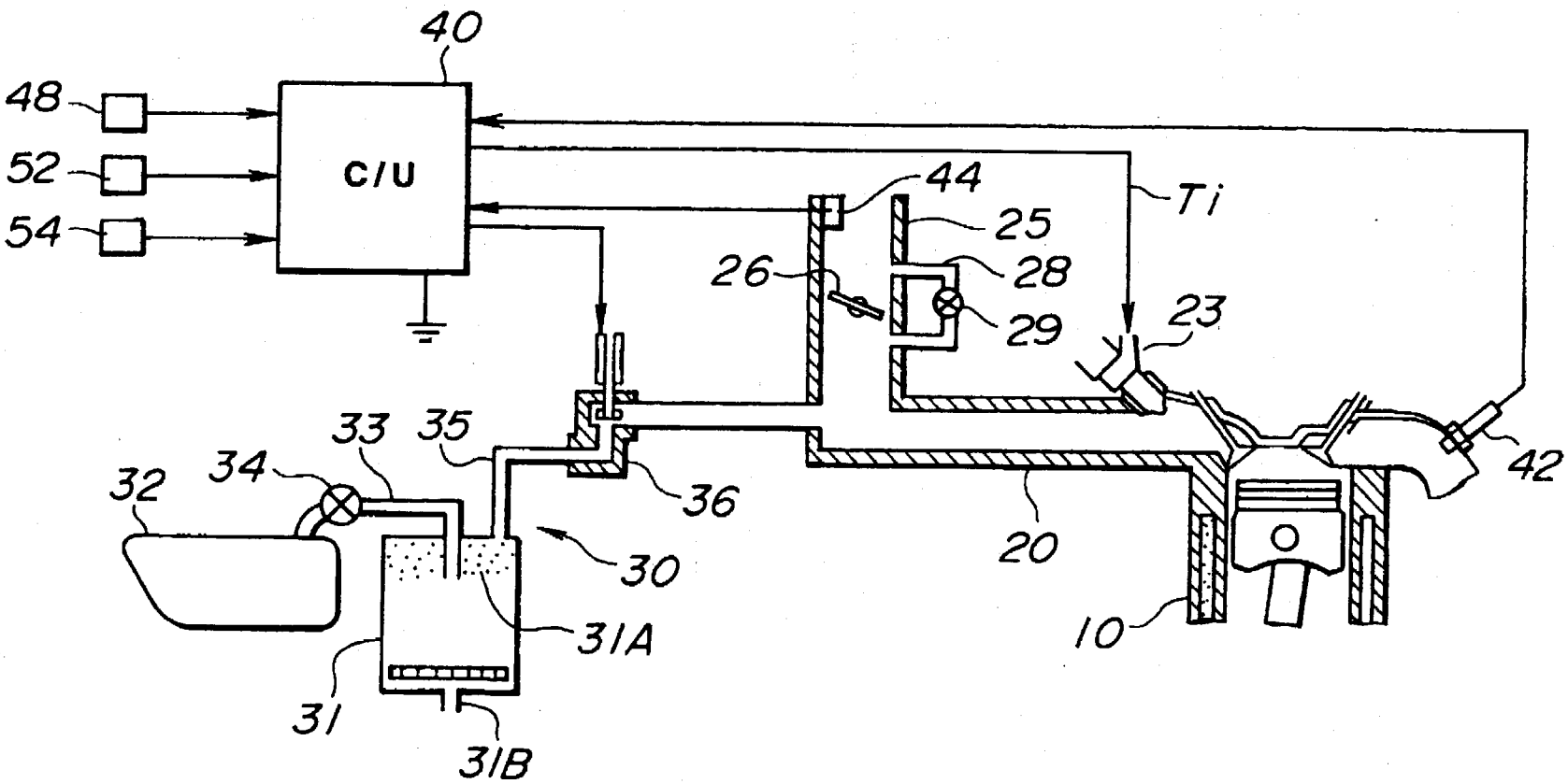
FIG. 16 is a schematic diagram showing a third embodiment of the fuel purging unit of the invention.

Referring to FIG. 16, there is shown a third embodiment of the invention. In this embodiment, the engine is substantially the same as described in connection with the first embodiment of FIG. 1 except for an auxiliary air passage 28 which opens at its opposite ends into the induction passage 25 to provide a bypass for the throttle valve 26. The auxiliary air passage 28 has an idle control valve 29 for controlling the flow through the auxiliary air passage 28. The control unit 40 receives signals from various sensors and controls the fuel injector 23 and the flow control valve 36. The sensors includes an oxygen sensor 42, an engine speed sensor 48 and a throttle position sensor 52. The throttle position sensor 54 is associated with the throttle valve 26 for producing a signal indicative of the throttle valve position, that is, the degree of opening of the throttle valve 26 with respect to its closed position. The control unit 40 also receives an ON/OFF signal from an ignition switch 52. The control unit 40 also controls the idle control valve 29 during engine idling to adjust the amount of air flow through the auxiliary air passage 28 for feedback control of the engine speed to a target idling speed value. The control unit 40 controls the duty (DUTY) of the flow control valve 36 based on the amount of air permitted to enter the engine and the accumulated purge air amount value to purge the fuel vapor to the engine induction passage 25 so as to provide a constant air/fuel ratio.

Figure 17A:
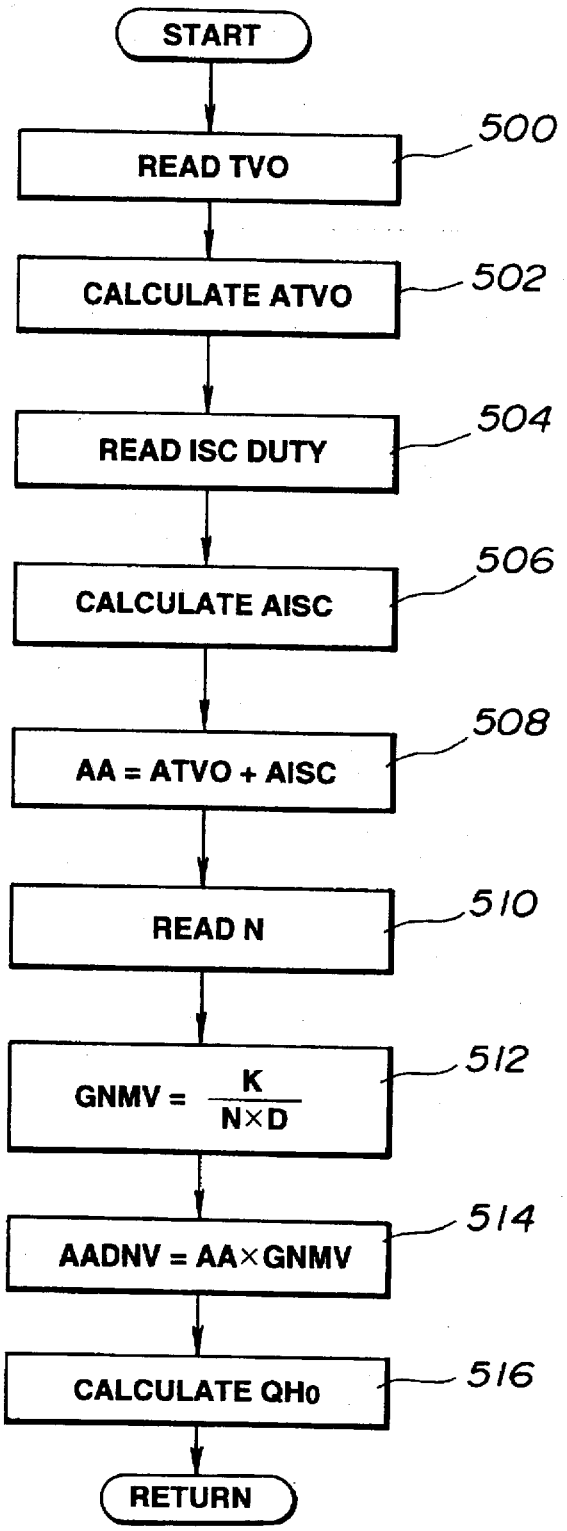
FIG. 17A is a flow chart.
Figure 17B:
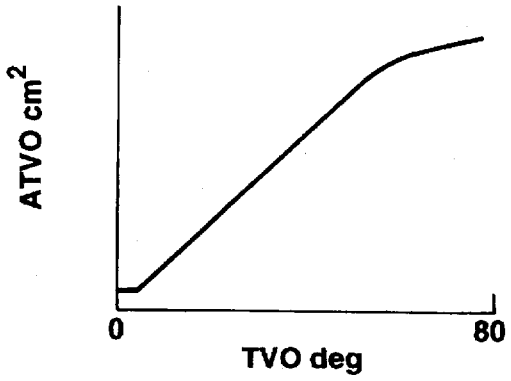
FIGS. 17B to 17D are graphs showing various map tables programmed into the computer.

FIG. 17A is a flow chart showing the programming of the digital computer used in the control unit 40 to calculate a volumetric flow rate coefficient. At the step 500, the throttle position TVO, which is indicated by the signal fed to the control unit 40 from the throttle position sensor 54, is read into the computer memory. At the step 502, the flow cross sectional area ATVO of the intake manifold 20 is calculated with the use of a map table programmed into the computer. This map table defines the intake manifold flow cross sectional area ATVO as a function of throttle position TVO, as shown in FIG. 17B. At the step 504, the duty ISDUTY of the idle control valve 29, that is, the idle control valve position, is read into the computer memory. The feedback control of the position of the idle control valve 29 is made during engine idling to retain a target engine idling speed value. Except for such a feedback control, the idle control valve 29 is controlled at a fixed position (duty). In this case, the fixed idle control valve position is read into the computer memory.

Figure 17C:
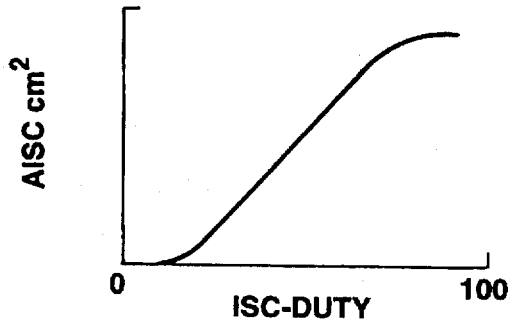

At the step 506, the flow cross sectional area AISC of the auxiliary air passage 28 is calculated from a map table programmed into the computer. This map table defines the auxiliary air passage flow cross sectional area AISC as a function of duty ISCDRY, as shown in FIG. 17C. At the step 508, the calculated auxiliary air passage flow cross sectional area AISC is added to the calculated intake manifold flow cross sectional area ATVO to calculate a total flow cross sectional area AA of the engine induction system. At the step 510, the engine speed N, which is indicated by the signal fed to the control unit 40 from the engine speed sensor 48, is read into the computer memory. At the step 512, a value GNMV, which corresponds to the negative pressure produced in the intake manifold 20 having a flow cross sectional area equal to the calculated value AA when the engine is operating at the speed N, is calculated as:

$$GNMV=K(N\times D)$$

where K is a constant and D is the displacement of the engine. At the step 514, a value AADNV, which corresponds to the negative pressure produced in the intake manifold 20 for the total induction passage flow cross sectional area AA calculated at the step 508, is calculated as:

$$AADNV=AA\times GNMV$$

Figure 17D:
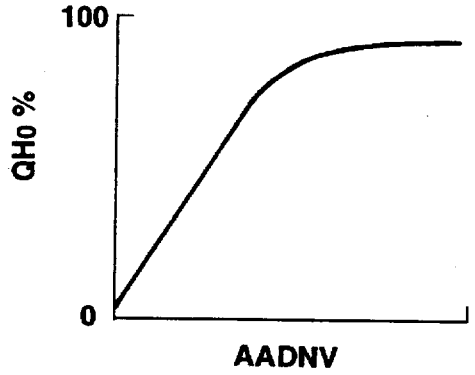

At the step 516, the volumetric flow rate coefficient QHo, that is, the percentage of the negative pressure AADNV with respect to the maximum volumetric flow rate obtained at the maximum induction passage flow cross sectional area, is calculated from a map table programmed into the computer. This map table defines the coefficient QHo as a function of negative pressure AAVND, as shown in FIG. 17D. The calculated coefficient QHo is used to calculate the maximum possible purge flow rate.

Figure 18A:
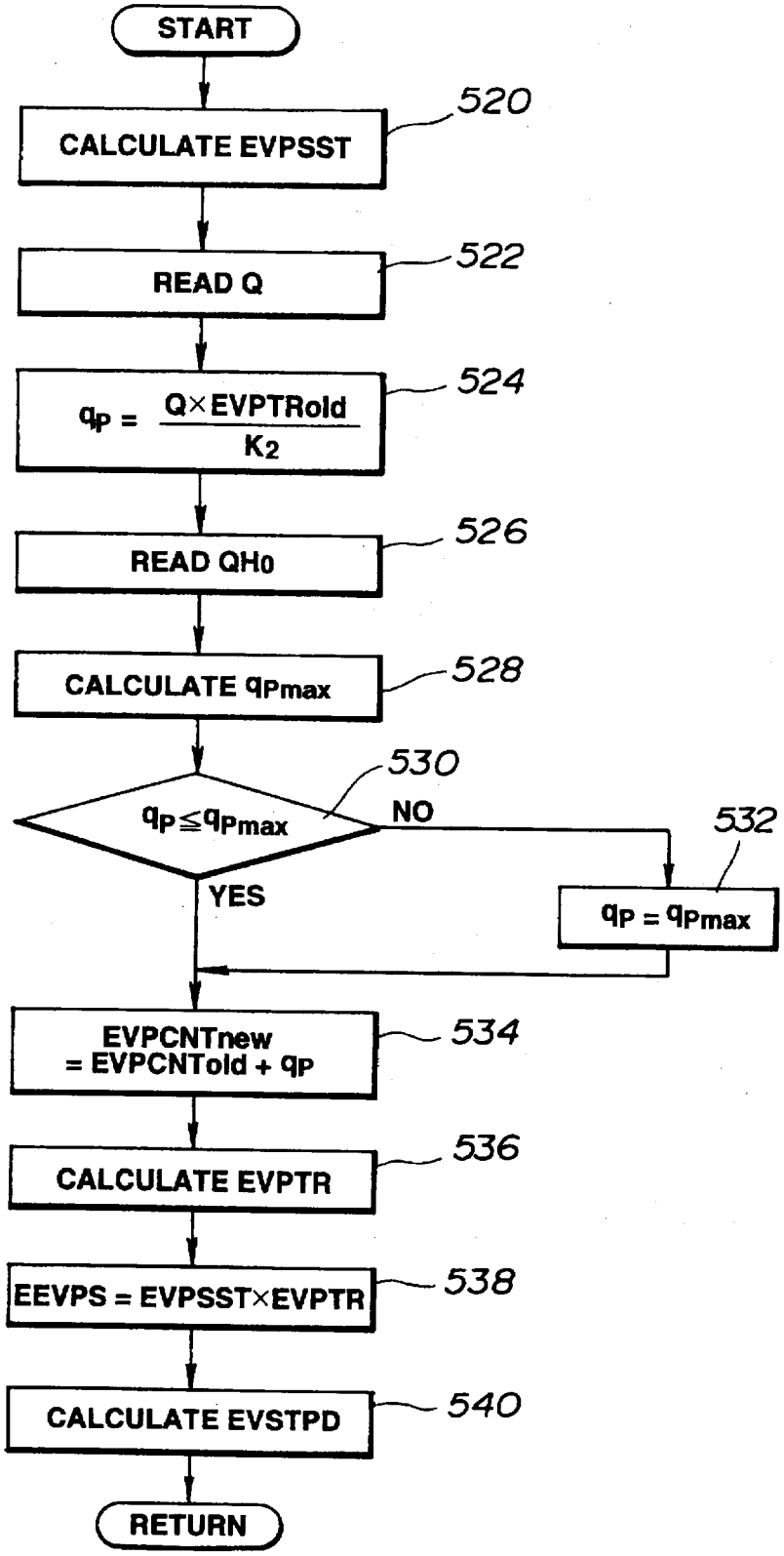
FIG. 18A is a flow chart.

FIG. 18A is a flow chart showing the programming of the digital computer as it is used for purge rate control. This program is repeated at regular intervals. At the step 520, the standard flow cross sectional area index EVPSST of the flow control valve 35 from a map table programmed into the computer. This map table defines the index EVPSST as a function of engine speed N and basic value Tp for fuel delivery requirement. The index EVPSST is used to correct the flow cross sectional area in a manner to achieve the same purge mixture flow rate according to the intake negative pressure on which the purge mixture flow rate depends. The standard flow cross sectional area index EVPSST is set at its minimum value when the canister 31 is charged with fuel vapor. A target purge rate value to be described later is multiplied by the standard flow cross sectional area index EVPSST to increase this index as the amount of fuel vapor residual in the canister 31 decreases. As a result, the purge mixture flow rate is smaller than a desired value even though the fuel control valve 36 opens fully at a small intake manifold negative pressure when the amount of fuel vapor residual in the canister decreases below a predetermined value.

At the step 522, the intake air flow Q, which is sensed by the airflow meter 44, is read into the computer memory. At the step 524, the required purge flow rate $q_p$ is calculated as:.

$$q_p=Q\cdot EVPTR_{OLD}/K2$$

where $EVPTR_{OLD}$ is the last target purge rate value calculated, during the last cycle of execution of the program, from the map table, and K2 is a constant. The required amount of fuel vapor may be set at a value proportional to the intake air flow Q in order to maintain a constant air/fuel ratio. Since the fuel vapor percentage in the purge mixture depends on the amount of fuel residual in the canister 31, however, the purge rate is set at a smaller value at a greater fuel vapor percentage to obtain a desired fuel vapor flow rate regardless of fuel vapor percentages.

Figure 18B:
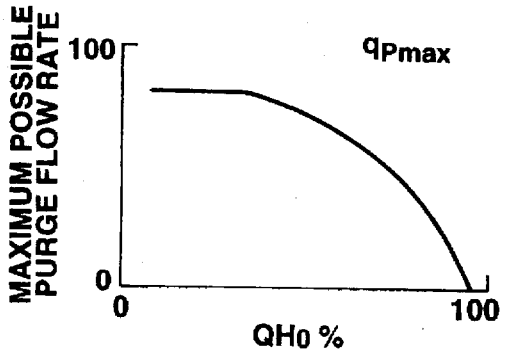
FIGS. 18B to 18D are graphs showing various map tables programmed into the computer.

At the step 526, the volumetric flow rate coefficient QHo calculated at the step 516 of FIG. 17A is read into the computer memory. At the step 528, the maximum possible purge flow rate $q_{pmax}$ which is the rate of flow through the purge passage 35 when the flow control valve 36 opens fully is calculated from a map table programmed into the computer. This map table defines the maximum possible purge flow rate $q_{pmax}$ as a function of the volumetric flow rate coefficient QHo, as shown in FIG. 18B. The intake manifold negative pressure decreases and the maximum possible purge flow rate $q_{pmax}$ decreases as the volumetric flow rate coefficient QHo increases. Although the maximum possible purge flow rate $q_{pmax}$ is calculated after the intake manifold negative pressure corresponding value AADNV is converted into a volumetric flow rate coefficient QHo, it is to be noted, of course, that the maximum possible purge flow rate $q_{pmax}$ may be derived directly from the intake manifold negative pressure corresponding value AADNV.

At the step 530, a determination is made as to whether or not the required purge flow rate $q_p$ calculated at the step 524 is equal to or less than the maximum possible purge flow rate $q_{pmax}$ calculated at the step 528. If the answer to this question is "yes", then the program proceeds to the step 534. Otherwise, the program proceeds to the step 532 where the required purge flow rate $q_p$ is set at the maximum possible purge flow rate $q_{pmax}$.

Figure 18C:
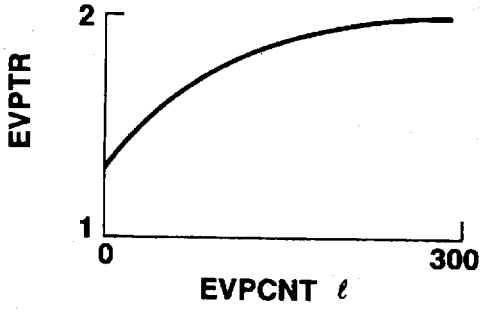

At the step 534, the required purge flow rate $q_p$ is added to the last accumulated purge air amount value $EVPCNT_{OLD}$ to calculate an updated or new accumulated purge air amount value $EVFCNT_{NEW}$. At the step 536, a new purge rate $EVPTR_{NEW}$ is calculated from a map table which defines the new purge rate as a function of the new accumulated purge air amount value $EVPCNT_{NEW}$, as shown in FIG. 18C. At the step 538, the target value for the flow cross sectional index EVFS of the flow control valve 36 is calculated as:

$$EVPS=EVPSST\cdot EVPTR_{NEW}$$

Figure 18D:
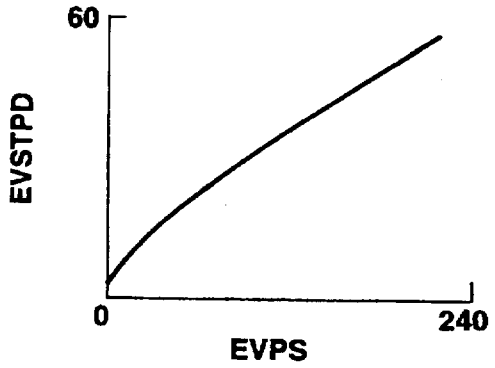

At the step 540, the duty ratio EVSTPD is calculated from a map table which defines it as a function of the target flow cross sectional index value EVPS of the flow control valve 36, as shown in FIG. 18D. The calculated duty ratio is converted into a control signal which is applied to operate the flow control valve 36 at the calculated duty ratio.

Figure 19:
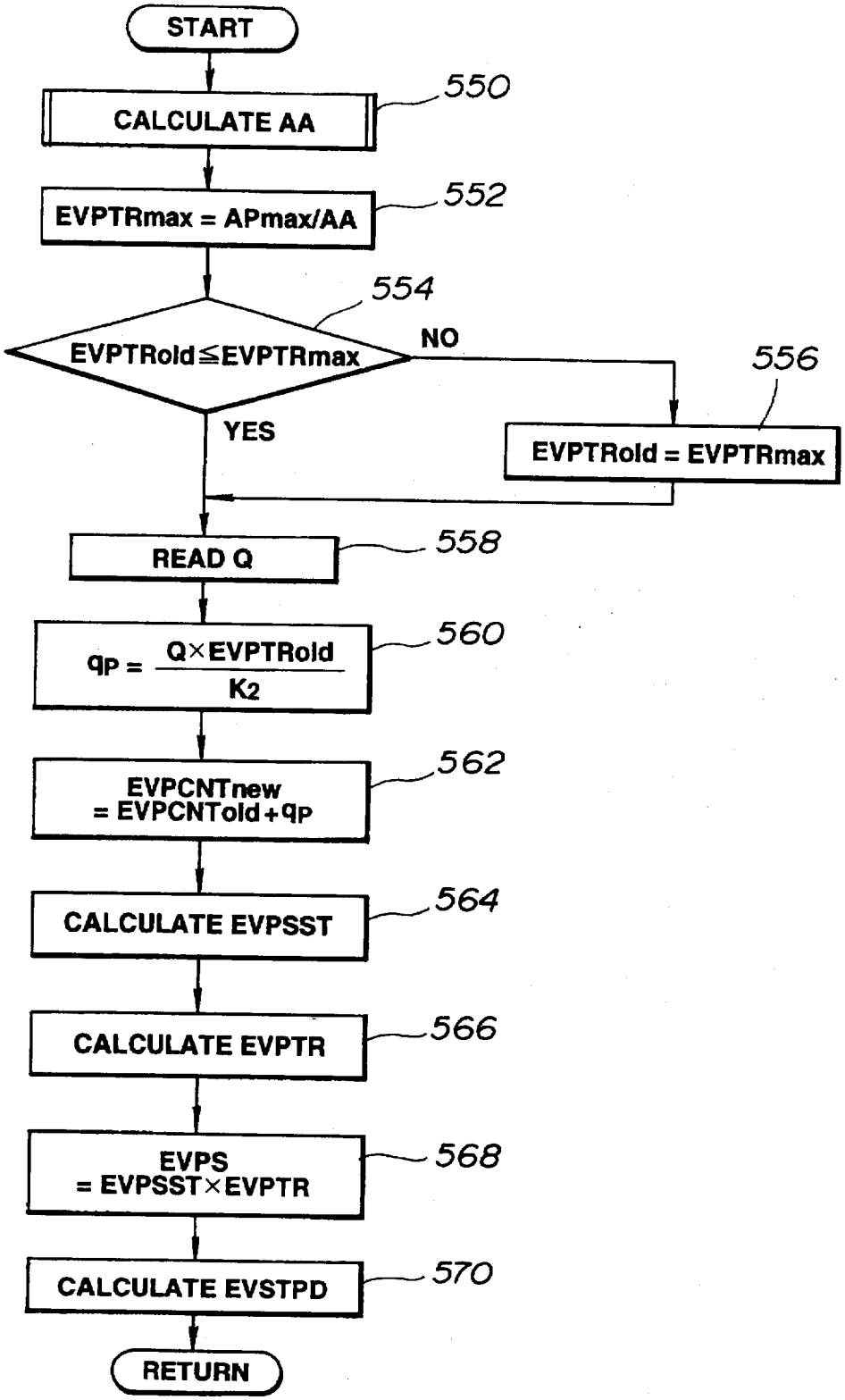
FIG. 19 is a flow chart.

FIG. 19 is a flow chart showing a modified form of the programming of the digital computer as it is used for purge rate control. This program is repeated at regular intervals. At the step 550, the total flow cross sectional area AA of the engine induction system is calculated substantially in the same manner as described in connection with the steps 500 to 508 of FIG. 17A. At the step 552, an upper purge rate limit $EVPTR_{max}$, which is obtained when the flow control valve 36 opens fully (duty=100%), is calculated as:

$$EVPTR_{max}=AP_{max}/AA$$

where $AP_{max}$ is the flow cross sectional area obtained when the flow control valve 36 opens fully. The flow rate Q of intake air admitted into the induction passage 25 is in direct proportion to the total flow cross sectional area AA of the engine intake system, whereas the purge flow rate is in direct proportion to the flow cross sectional area AP of the flow control valve 36. Since the ratio of the flow cross sectional area AP with respect to the total flow cross sectional area AA indicates the ratio of the purge flow rate with respect to the flow rate of intake air admitted into the induction passage 25, that is, the actual purge flow rate, the upper purge rate limit $EVPTR_{max}$ is obtained as the ratio of the maximum flow cross sectional area $AP_{max}$ with respect to the total flow cross sectional area AA.

At the step 554, a determination is made as to whether or not the last target purge flow rate $EVPTR_{OLD}$ is equal to or less than the upper purge rate limit $EVPTR_{max}$. If the answer to this question is "yes", then the program proceeds to the step 558. Otherwise, the program proceeds to the step 556 where the last target purge flow rate $EVPTR_{OLD}$ is set at the upper purge rate limit $EVPTR_{max}$.

At the step 558, the intake air flow Q, which is sensed by the airflow meter 44, is read into the computer memory. At the step 560, the required purge flow rate $q_p$ is calculated as:

$$q_p=Q\cdot EVPTR_{OLD}/K2$$

where $EVPTR_{OLD}$ is the last target purge rate value calculated, during the last cycle of execution of the program, from the map table, and K2 is a constant. The required amount of fuel vapor may be set at a value proportional to the intake air flow Q in order to maintain a constant air/fuel ratio. Since the fuel vapor percentage in the purge mixture depends on the amount of fuel residual in the canister 31, however, the purge rate is set at a smaller value at a greater fuel vapor percentage to obtain a desired fuel vapor flow rate regardless of fuel vapor per centages.

At the step 562, the required purge flow rate $q_p$ is added to the last accumulated purge air amount value $EVPCNT_{OLD}$ to calculate an updated or new accumulated purge air amount value $EVPCNT_{NEW}$. At the step 564, the standard flow cross sectional area index EVPSST is calculated from a map table programmed into the computer. At the step 566, a new purge rate $EVPTR_{NEW}$ is calculated from a map table which defines the new purge rate as a function of the new accumulated purge air amount value $EVPCNT_{NEW}$. At the step 568, the target value for the flow cross sectional index EVPS of the flow control valve 36 is calculated as:

$$EVPS=EVPSST\cdot EVPTR_{NEW}$$

At the step 570, the duty ratio EVSTPD is calculated from a map table which defines it as a function of the target flow cross sectional index value EVPS of the flow control valve 36. The calculated duty ratio is converted into a control signal which is applied to operate the flow control valve 36 at the calculated duty ratio.

This modification eliminates the need for calculations of the intake manifold negative pressure corresponding value with the use of the engine speed N.

Figure 20:
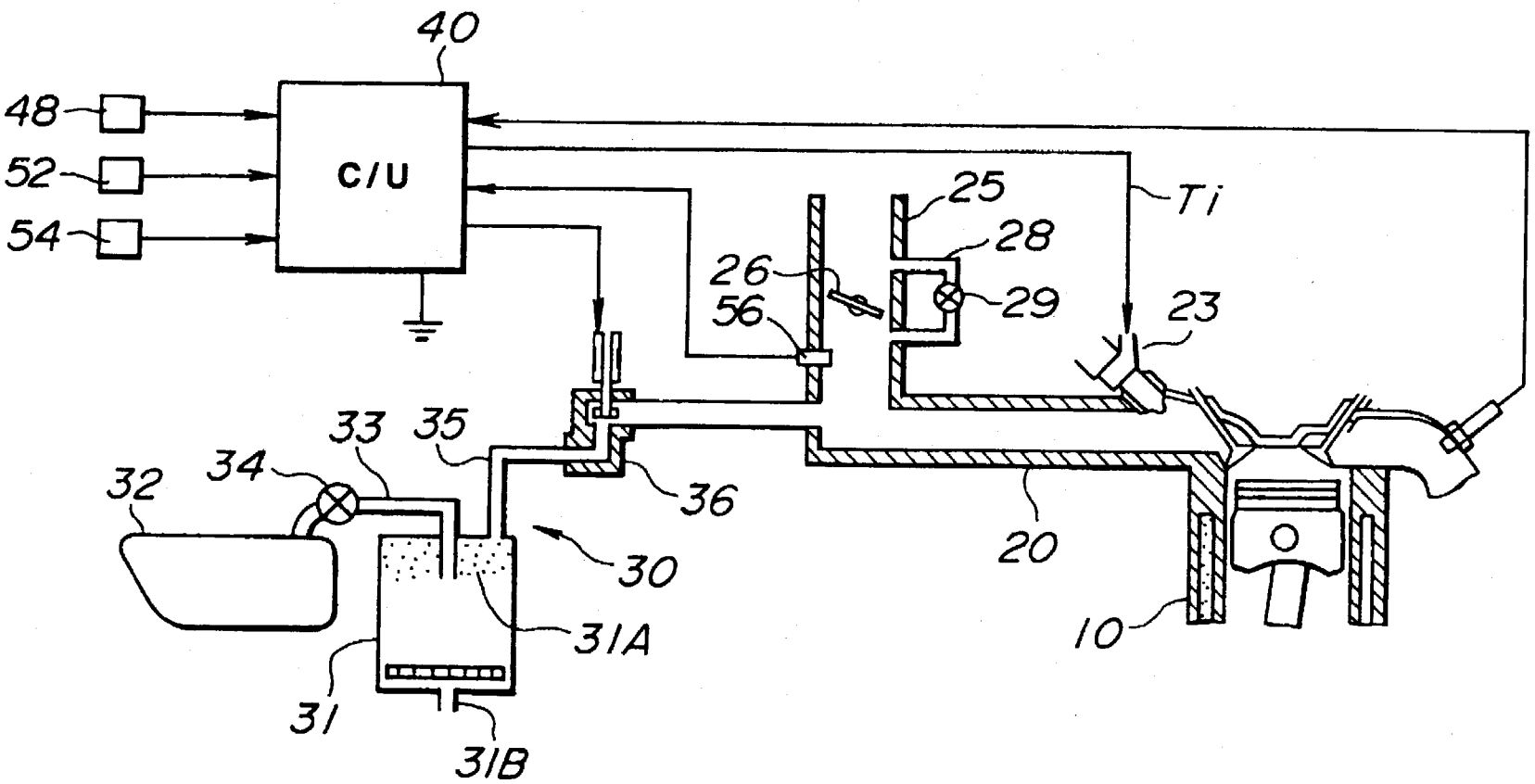
FIG. 20 is a schematic diagram showing a fourth embodiment of the fuel purging unit of the invention.

Referring to FIG. 20, there is shown a fourth embodiment of the invention. This embodiment is substantially the same as the third embodiment of FIG. 16 except for a negative pressure sensor 56 provided in the induction passage 25 at a position downstream of the throttle valve 26 for producing a signal indicative of a negative pressure produced in the intake manifold 20.

Figure 21A:
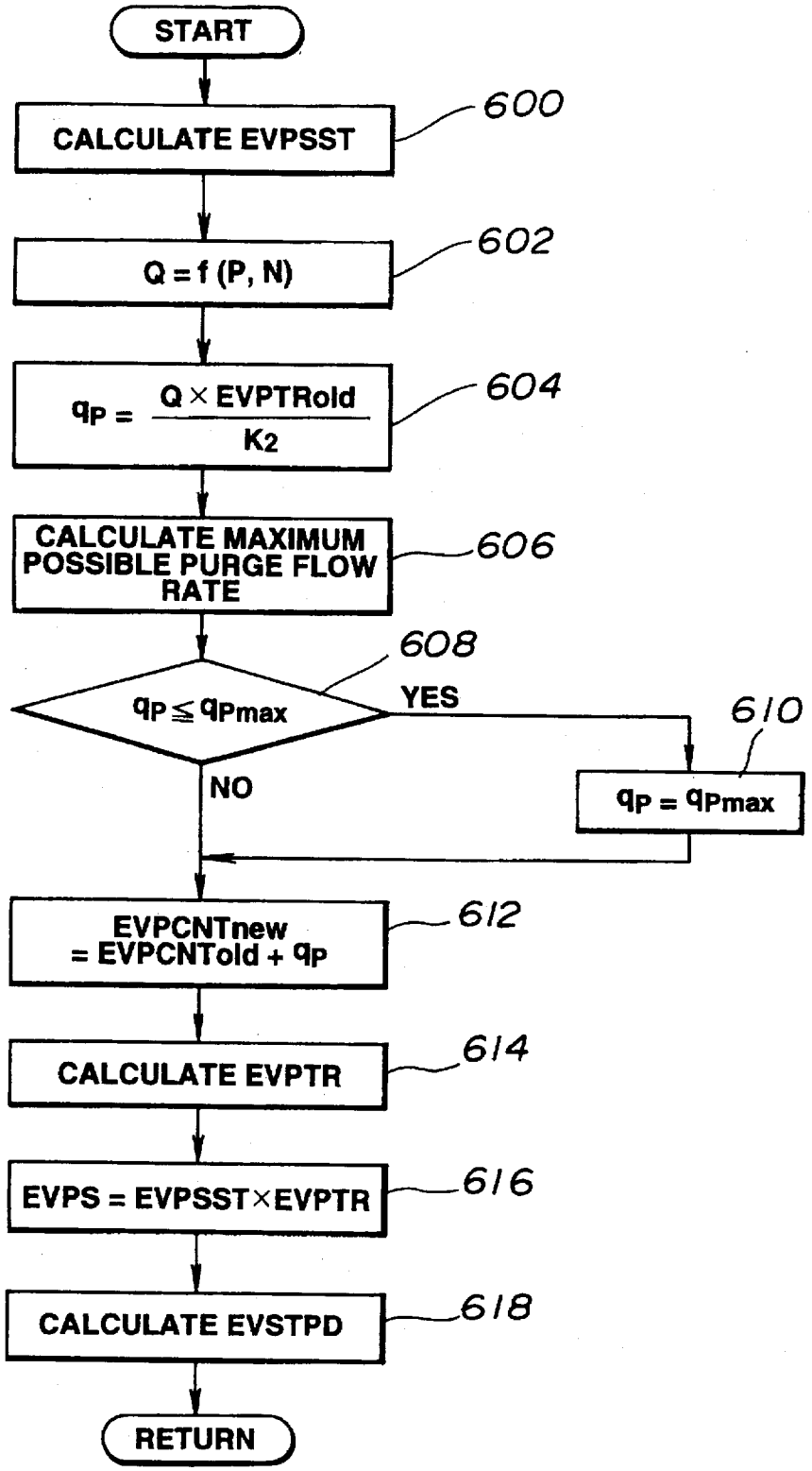
FIG. 21A is a flow chart.

FIG. 21A is a flow chart showing the programming of the digital computer as it is used for purge rate control. This program is repeated at regular intervals. At the step 600, the standard flow cross sectional area index EVPSST of the flow control valve 36 from a map table programmed into the computer. This map table defines the index EVPSST as a function of engine speed N and basic value Tp for fuel delivery requirement. The index EVPSST is used to correct the flow cross sectional area in a manner to achieve the same purge mixture flow rate according to the intake negative pressure on which the purge mixture flow rate depends. The standard flow cross sectional area index EVPSST is set at its minimum value when the canister 31 is charged with fuel vapor. A target purge rate value to be described later is multiplied by the standard flow cross sectional area index EVPSST to increase this index as the amount of fuel vapor residual in the canister 31 decreases. As a result, the purge mixture flow rate is smaller than a desired value even though the fuel control valve 36 opens fully at a small intake manifold negative pressure when the amount of fuel vapor residual in the canister decreases below a predetermined value.

At the step 602, the intake air flow Q is calculated as a function of the intake manifold negative pressure P sensed by the negative pressure sensor 56 and the engine speed N sensed by the engine speed sensor 48. At the step 604, the required purge flow rate $q_p$ is calculated as:

$$q_p=Q\cdot EVPTR_{OLD}/K2$$

where $EVPTR_{OLD}$ is the last target purge rate value calculated, during the last cycle of execution of the program, from the map table, and K2 is a constant. The required amount of fuel vapor may be set at a value proportional to the intake air flow Q in order to maintain a constant air/fuel ratio. Since the fuel vapor percentage in the purge mixture depends on the amount of fuel residual in the canister 31, however, the purge rate is set at a smaller value at a greater fuel vapor percentage to obtain a desired fuel vapor flow rate regardless of fuel vapor percentages.

Figure 21B:
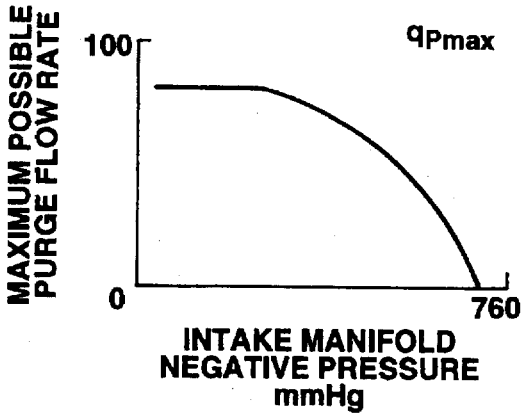
FIGS. 21B to 21D are graphs showing various map tables programmed into the computer.

At the step 606, the maximum possible purge flow rate $q_{pmax}$ which is the rate of flow through the purge passage 35 when the flow control valve 36 opens fully is calculated from a map table programmed into the computer. This map table defines the maximum possible purge flow rate $q_{pmax}$ as a function of negative pressure P, as shown in in FIG. 21B. At the step 608, a determination is made as to whether or not the required purge flow rate $q_p$ calculated at the step 604 is equal to or less than the maximum possible purge flow rate $q_{pmax}$ calculated at the step 606. If the answer to this question is "yes", then the program proceeds to the step 612. Otherwise, the program proceeds to the step 610 where the required purge flow rate $q_p$ is set at the maximum possible purge flow rate $q_{pmax}$.

Figure 21C:
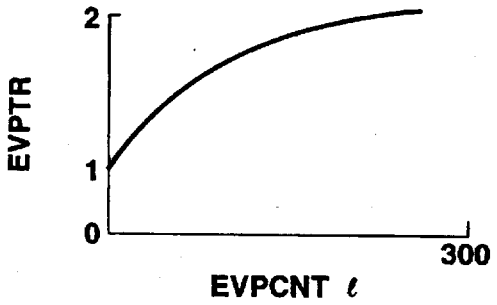

At the step 612, the required purge flow rate $q_p$ is added to the last accumulated purge air amount value $EVPCNT^{OLD}$ to calculate an updated or new accumulated purge air amount value $EVPCNT_{NEW}$. At the step 614, a new purge rate $EVPTR_{NEW}$ is calculated from a map table which defines the new purge rate as a function of the new accumulated purge air amount value $EVPCNT_{NEW}$, as shown in FIG. 21C. At the step 616, the target value for the flow cross sectional index EVPS of the flow control valve 36 is calculated as:

$$EVPS=EVPSST\cdot EVPTR_{NEW}$$

Figure 21D:
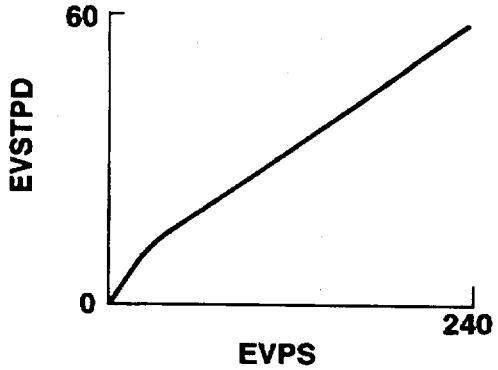

At the step 618, the duty ratio EVSTPD is calculated from a map table which defines it as a function of the target flow cross sectional index value EVPS of the flow control valve 36, as shown in FIG. 21D. The calculated duty ratio is converted into a control signal which is applied to operate the flow control valve 36 at the calculated duty ratio.

Figure 22:
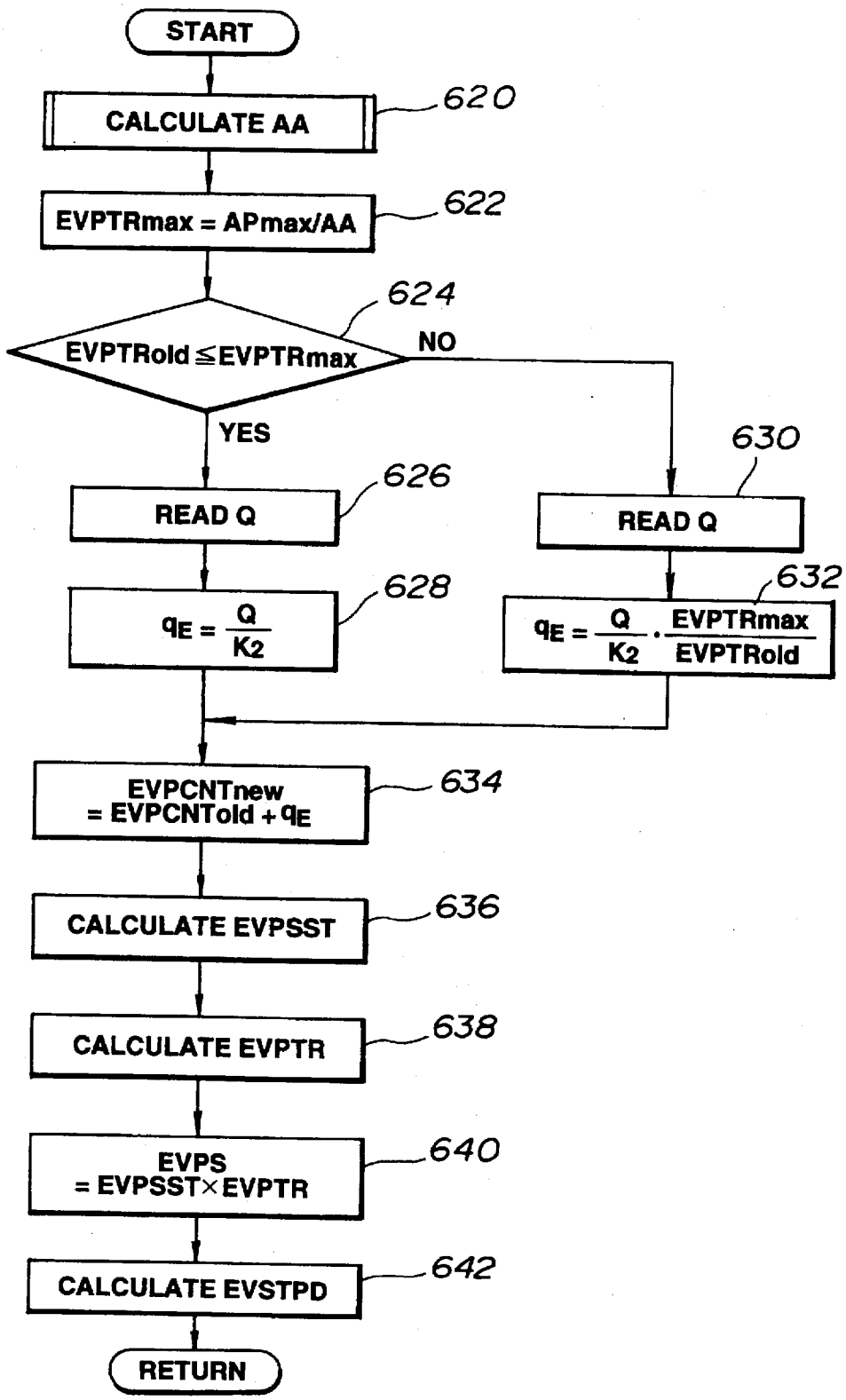
FIG. 22 is a flow chart.

FIG. 22 is a flow chart showing a modified form of the programming of the digital computer as it is used for purge rate control. This program is repeated at regular intervals. At the step 620, the total flow cross sectional area AA of the engine induction system is calculated substantially in the same manner as described in connection with the steps 500 to 508 of FIG. 17A. At the step 622, an upper purge rate limit $EVPTR_{max}$, which is obtained when the flow control valve 36 opens fully (duty=100%), is calculated as:

$$EVPTR_{max}=AP_{max}/AA$$

where $AP_{max}$ is the flow cross sectional area obtained when the flow control valve 36 opens fully. The flow rate Q of intake air admitted into the induction passage 25 is in direct proportion to the total flow cross sectional area AA of the engine intake system, whereas the purge flow rate is in direct proportion to the flow cross sectional area AP of the flow control valve 36. Since the ratio of the flow cross sectional area AP with respect to the total flow cross sectional area AA indicates the ratio of the purge flow rate with respect to the flow rate of intake air admitted into the induction passage 25, that is, the actual purge flow rate, the upper purge rate limit $EVPTR_{max}$ is obtained as the ratio of the maximum flow cross sectional area $AP_{max}$ with respect to the total flow cross sectional area AA.

At the step 624, a determination is made as to whether or not the last target purge flow rate $EVPTR_{OLD}$ is equal to or less than the upper purge rate limit $EVPTR_{max}$. If the answer to this question is "yes", then the program proceeds to the step 626 where the intake air flow Q, which is sensed by the airflow meter 44, is read into the computer memory. At the step 628, the required purge fuel vapor flow rate $q_E$ is calculated as $q_E=Q/K2$, where K2 is a constant. If $EVPTR_{OLD}>EVPTR_{max}$, then the program proceeds from the step 624 to the step 630 where the intake air flow Q, which is sensed by the airflow meter 44, is read into the computer memory. At the step 632, the required purge fuel vapor flow rate $q_E$ is calculated as $q_E=(Q/K2)\cdot(EVPTR_{max}/EVPTR_{OLD})$.

At the step 634, the required purge fuel vapor flow rate $q_E$ is added to the last accumulated purge air amount value $EVPCNT_{OLD}$ to calculate an updated or new accumulated purge air amount value $EVPCNT_{NEW}$. At the step 636, the standard flow cross sectional area index EVPSST is calculated from a map table programmed into the computer. At the step 638, a new purge rate $EVPTR_{NEW}$ is calculated from a map table which defines the new purge rate as a function of the new accumulated purge air amount value $EVPCNT_{NEW}$. At the step 640, the target value for the flow cross sectional index EVPS of the flow control valve 36 is calculated as:

$$EVPS=EVPSST\cdot EVPTR_{NEW}$$

At the step 642, the duty ratio EVSTPD is calculated from a map table which defines it as a function of the target flow cross sectional index value EVPS of the flow control valve 36. The calculated duty ratio is converted into a control signal which is applied to operate the flow control valve 36 at the calculated duty ratio.

In this embodiment, the purge rate, which corresponds to the degree of opening of the flow control valve 36, is controlled to provide a required purge flow rate calculated based on engine operating conditions. The required purge flow rate is corrected based on an accumulated purge flow rate value. The required purge flow rate is limited to a maximum possible purge flow rate when the required purge flow rate exceeds the maximum possible purge flow rate calculated based on engine operating conditions. This is effective to avoid the case where a greater value is calculated for the accumulated purge flow rate than accumulated actually. This case will occur particularly at small intake manifold negative pressures. The maximum possible purge flow rate is the purge flow rate obtained when the flow control valve 36 opens fully and it may be calculated based on an intake manifold negative pressure corresponding value which is calculated based on the flow cross sectional area of the engine intake manifold and the engine speed.

The engine intake air flow rate is in direct proportion to the flow cross sectional area of the, engine intake manifold 20 and the purge flow rate is in direct proportion to the degree of opening of the flow control valve 36. Thus, the ratio of the opening degree of the flow control valve 36 with respect to the flow cross sectional area of the engine intake manifold 20 is equal to the ratio of the purge flow rate with respect to the intake air flow rate, that is, the purge rate. The upper purge rate limit can be calculated based on the ratio of the ratio of the maximum flow cross sectional area of the purge passage obtained when the flow control valve 36 opens full to the flow cross sectional area of the intake manifold 20. It is, therefore, possible to calculate the maximum possible purge flow rate based on the upper purge rate limit. When the target purge rate set based on the accumulated purge flow rate value exceeds the upper purge rate limit, the actual purge flow rate is limited to the maximum possible purge flow rate. It is, therefore, possible to calculate a correct accumulated value by calculating an accumulated purge fuel vapor flow rate value based on the maximum possible purge flow rate calculated based on the upper purge rate limit.

The purge fuel vapor flow rate is represented by the required purge flow rate. The purge rate control can be made by a simple arrangement since the accumulated purge flow rate value is calculated based on engine operating conditions rather than measured actually.

The amount of fuel vapor residual in the canister 31 decreases and the percentage of the purge fuel vapor in the purge air-fuel mixture as the accumulated fuel vapor flow rate value increases. In order to maintain the air/fuel ratio of the purge mixture, it is required to increase the ratio of the purge flow rate with respect to the engine intake air flow rate. For this reason, a target purge rate, that is, a target ratio of the purge flow rate with respect to the engine intake air flow rate, is set based on the accumulated purge flow rate value. The target purge rate is used, along with the engine intake air flow rate, to calculate the required purge flow rate. It is, therefore, possible to set the required purge flow rate to maintain a constant air/fuel ratio of the purge mixture passing through the purge passage 35.

Persons of ordinary skill in the art, upon comprehending the present invention as described and illustrated herein can be expected to consider obvious modifications and variations of the above-described configurations, sizes, and materials to suit particular exigencies of use. All such variations and modifications are considered to be comprehended within the present invention which is limited solely by the claims appended hereunder.

What is claimed:

1. A method of purging a canister containing an absorbent, the canister being connected to a fuel tank to permit therein to evaporated fuel from the fuel tank to be absorbed by the absorbent, the canister having a purge air inlet and a purge air outlet connected to one end of a purge passage having therein a flow control valve, the purge passage having an opposite end connected to an induction passage of an internal combustion engine at a portion downstream of a throttle valve disposed in the induction passage, the method comprising the steps of:

detecting flow of intake air passing through the induction passage at a portion upstream of the throttle valve and generating an intake air flow indicative signal indicative of the detected flow of intake air;

deriving an intake air flow rate from said intake air flow indicative signal;

calculating a product of said derived intake air flow rate and a purge rate;

incrementing a counter by a value proportional to said calculated product;

determining a target value of said purge rate in response to said counter; and adjusting the flow control valve in response to said determined target value of said purge rate.

2. A method as claimed in claim 1, wherein said purge rate is expressed as, $$PR=(Q_{PA}/Q_{IA})\times 100$$

where,

PR: purge rate, $Q_{PA}$: flow rate of purge air, $Q_{IA}$: flow rate of intake air.

3. A method as claimed in claim 2, wherein said counter is expressed as, $$CNT=Q_{IA}\times PR\times KDUTY$$

where,

CNT: counter

KDUTY: constant.

4. A method as claimed in claim 3, wherein said step of determining said target value of said purge rate includes a step of performing a table look-up of a table containing various values of said purge rate against various values of said counter.

5. A method as claimed in claim 4, wherein, for the same target value of a deviation from the stoichiometry, said various values of said purge rate depend on varying air fuel ratios of the purge air.

6. A method as claimed in claim 1, wherein when said counter exceeds a predetermined value, said purge rate is fixed at the minimum value.

7. A method of purging a canister containing an absorbent, the canister being connected to a fuel tank to permit therein to evaporated fuel from the fuel tank to be absorbed by the absorbent, the canister having a purge air inlet and a purge air outlet connected to one end of a purge passage having therein a flow control valve, the purge passage having an opposite end connected to an induction passage of an internal combustion engine at a portion downstream of a throttle valve disposed in the induction passage, the method comprising the steps of:

detecting flow of intake air passing through the induction passage at a portion upstream of the throttle valve and generating an intake air flow indicative signal indicative of the detected flow of intake air;

deriving an intake air flow rate from said intake air flow indicative signal;

calculating a product of said derived intake air flow rate and a purge rate;

incrementing a counter by a value proportional to said calculated produce;

determining a target value of said purge rate out of various values of said purge rate contained in a table in response to said counter, the arrangement being such that, with a predetermined target value of deviation from the stoichiometry, said various values of said purge rate contained in said table are dependent on various values of said counter; and adjusting the flow control valve in response to said determined target value of said purge rate.

8. A method as claimed in claim 7, wherein said purge rate is expressed as, $$PR=(Q_{PA}/Q_{IA})\times 100$$

where,

PR: purge rate, $Q_{PA}$: flow rate of purge air, $Q_{IA}$: flow rate of intake air.

9. A method as claimed in claim 8, wherein said counter is expressed as, $$CNT=Q_{IA}\times PR\times KDUTY$$

where,

CNT: counter

KDUTY: constant.

10. A method of purging a canister containing an absorbent, the canister being connected to a fuel tank to permit thereinto evaporated fuel from the fuel tank to be absorbed by the absorbent, the canister having a purge air inlet and a purge air outlet connected to one end of a purge passage having therein a flow control valve, the purge passage having an opposite end connected to an induction passage of an internal combustion engine at a portion downstream of a throttle valve disposed in the induction passage, the method comprising the steps of:

accumulating an amount of fuel vapor purged from the canister after the engine starts;

storing the accumulated purge fuel vapor amount at least for a predetermined time after the engine stops;

detecting a time interval between a time at which the engine stops and a time at which the engine restarts;

setting a purge rate characteristic based on the accumulated purge fuel vapor amount stored when the engine starts and the detected time interval, the purge rate characteristic defining purge rate as a function of accumulated purge fuel vapor amount after the engine starts;

calculating a purge rate according to the set purge rate characteristic; and adjusting the flow control valve to provide the calculated purge rate.

11. A method as claimed in claim 10, wherein the time interval is derived from an engine coolant temperature.

12. A method as claimed in claim 10, wherein the purge rate increases at an increasing rate as the stored accumulated purge fuel vapor amount increases and as the detected time interval decreases.

13. A method as claimed in claim 12, wherein the time interval is derived from an engine coolant temperature.

14. A method as claimed in claim 12, wherein the purge rate has an initial value used for purge rate control when engine starts, the initial value increasing as the accumulated purge fuel vapor amount increases.

15. A method as claimed in claim 14, wherein the time interval is derived from an engine coolant temperature.

16. A method of purging a canister containing an absorbent, the canister being connected to a fuel tank to permit thereinto evaporated fuel from the fuel tank to be absorbed by the absorbent, the canister having a purge air inlet and a purge air outlet connected to one end of a purge passage having therein a flow control valve, the purge passage having an opposite end connected to an induction passage of an internal combustion engine at a portion downstream of a throttle valve disposed in the induction passage, the method comprising the steps of:

detecting engine operating conditions;

calculating a required purge flow rate based on the detected engine operating conditions;

controlling the flow control valve based on the detected engine operating conditions and the calculated required purge flow rate;

calculating a maximum possible purge flow rate based on the detected engine operating conditions;

selected a lower one of the required purge flow rate and the maximum possible purge flow rate after the engine starts; and correcting the required purge flow rate based on the selected purge flow rate.

17. A method as claimed in claim 16, wherein the detected engine operating conditions include a flow cross sectional area of the induction passage and an engine speed, and wherein the maximum possible purge flow rate is calculated based on the induction passage flow cross sectional area and the engine speed.

18. A method as claimed in claim 16, wherein an upper purge rate limit is set at a ratio of a maximum flow cross sectional area of the purge passage obtained when the flow control valve opens fully with respect to an flow cross sectional area of the induction passage, and wherein the maximum possible purge flow rate is calculated based on the upper purge rate limit.

19. A method as claimed in claim 18, wherein the maximum possible purge flow rate calculated based on the upper purge rate limit is accumulated when the target purge rate exceeds the upper purge rate limit.

20. A method as claimed in claim 16, wherein the engine operating conditions include an engine intake manifold negative pressure, and wherein the maximum possible purge flow rate is calculated based on the engine intake manifold negative pressure.

21. A method as claimed in claim 16, wherein the detected engine operating conditions include an intake air flow rate, and wherein the required purge flow rate is calculated based on the intake air flow rate and a target purge rate calculated based on the accumulated purge flow rate, the target purge rate being a target percentage of the purge flow rate with respect to the intake air flow rate.

22. A method as claimed in claim 21, wherein the detected engine operating conditions include a flow cross sectional area of the induction passage and an engine speed, and wherein the maximum possible purge flow rate is calculated based on the induction passage flow cross sectional area and the engine speed.

23. A method as claimed in claim 21, wherein an upper purge rate limit is set at a ratio of a maximum flow cross sectional area of the purge passage obtained when the flow control valve opens fully with respect to an flow cross sectional area of the induction passage, and wherein the maximum possible purge flow rate is calculated based on the upper purge rate limit.

24. A method as claimed in claim 23, wherein the maximum possible purge flow rate calculated based on the upper purge rate limit is accumulated when the target purge rate exceeds the upper purge rate limit.

25. A method as claimed in claim 21, wherein the engine operating conditions include an engine intake manifold negative pressure, and wherein the maximum possible purge flow rate is calculated based on the engine intake manifold negative pressure.

26. A system for purging a canister containing an absorbent, the canister being connected to a fuel tank to permit thereunto evaporated fuel from the fuel tank to be absorbed by the absorbent, the canister having a purge air inlet and a purge air outlet connected to one end of a purge passage, the purge passage having an opposite end connected to an induction passage of an internal combustion engine at a portion downstream of a throttle valve disposed in the induction passage, the system comprising:

means for detecting flow of intake air passing through the induction passage at a portion upstream of the throttle valve and generating an intake air flow indicative signal indicative of the detected flow of intake air;

a control unit which derives an intake air flow rate from said intake air flow indicative signal; calculates a product of said derived intake air flow rate and a purge rate; increments a counter by a value proportional to said calculated produce; determines target value of said purge rate in response to said counter; and produces an output signal in response to said determined target value of said purge rate; and means for controlling the purge passage in response to said control signal.

27. A system as claimed in claim 26, wherein said controlling means includes a flow control valve in the purge passage.

28. A system for purging a canister containing an absorbent, the canister being connected to a fuel tank to permit thereinto evaporated fuel from the fuel tank to be absorbed by the absorbent, the canister having a purge air inlet and a purge air outlet connected to one end of a purge passage, the purge passage having an opposite end connected to an induction passage of an internal combustion engine at a portion downstream of a throttle valve disposed in the induction passage, the system comprising:

means for detecting flow of intake air passing through the induction passage at a portion upstream of the throttle valve and generating an intake air flow indicative signal indicative of the detected flow of intake air;

a control unit which derives an intake air flow rate from said intake air flow indicative signal; calculates a product of said derived intake air flow rate and a purge rate; increments a counter by a value proportional to said calculated produce; determines a target value of said purge rate out of various values of said purge rate contained in a table in response to said counter, the arrangement having such that, with a predetermined target value of deviation from the stoichiometry, said various values of said purge rate contained in said table are dependent on various values of said counter; and produces a control signal in response to said determined target value; and means for controlling the purge passage in response to said control signal.

29. A system as claimed in claim 28, wherein said controlling means includes a flow control valve in the purge passage.

30. A system for purging a canister containing an absorbent, the canister being connected to a fuel tank to permit thereinto evaporated fuel from the fuel tank to be absorbed by the absorbent, the canister having a purge air inlet and a purge air outlet connected to one end of a purge passage having therein a flow control valve, the purge passage having an opposite end connected to an induction passage of an internal combustion engine at a portion downstream of a throttle valve disposed in the induction passage, the system comprising:

means for accumulating an amount of fuel vapor purged from the canister after the engine starts;

means for storing the accumulated purge fuel vapor amount at least for a predetermined time after the engine stops;

means for detecting a time interval between a time at which the engine stops and a time at which the engine restarts;

means for setting a purge rate characteristic based on the accumulated purge fuel vapor amount stored when the engine starts and the detected time interval, the purge rate characteristic defining purge rate as a function of accumulated purge fuel vapor amount after the engine starts;

means for calculating a purge rate according to the set purge rate characteristic; and means for adjusting the flow control valve to provide the calculated purge rate.

31. A system as claimed in claim 30, wherein said time interval detecting means includes means for deriving the time interval from an engine coolant temperature.

32. A system as claimed in claim 30, wherein said purge rate characteristic setting means includes means for setting a purge rate characteristic defining a purge rate increasing at an increasing rate as the stored accumulated purge fuel vapor amount increases and as the detected time interval decreases.

33. A system as claimed in claim 32, wherein said time interval detecting means includes means for deriving the time interval from an engine coolant temperature.

34. A system as claimed in claim 32, wherein said purge rate characteristic setting means includes means for setting a purge rate having an initial value used for purge rate control when engine starts, the initial value increasing as the accumulated purge fuel vapor amount increases.

35. A system as claimed in claim 34, wherein said time interval detecting means includes means for deriving the time interval from an engine coolant temperature.

36. A system for purging a canister containing an absorbent, the canister being connected to a fuel tank to permit thereinto evaporated fuel from the fuel tank to be absorbed by the absorbent, the canister having a purge air inlet and a purge air outlet connected to one end of a purge passage having therein a flow control valve, the purge passage having an opposite end connected to an induction passage of an internal combustion engine at a portion downstream of a throttle valve disposed in the induction passage, the system comprising:

means for detecting engine operating conditions;

means for calculating a required purge flow rate based on the detected engine operating conditions;

means for controlling the flow control valve based on the detected engine operating conditions and the calculated required purge flow rate;

means for calculating a maximum possible purge flow rate based on the detected engine operating conditions;

means for selecting a lower one of the required purge flow rate and the maximum possible purge flow rate after the engine starts; and means for correcting the required purge flow rate based on the selected purge flow rate.

37. A system as claimed in claim 36, wherein the engine operating condition detecting means includes means for detecting a flow cross sectional area of the induction passage and means for detecting an engine speed, and wherein the maximum possible purge flow rate calculating means includes means for calculating the maximum possible purge flow rate based on the induction passage flow cross sectional area and the engine speed.

38. A system as claimed in claim 36, wherein the engine operating condition detecting means includes means for detecting a flow cross sectional area of the induction passage, wherein the maximum possible purge flow rate calculating means includes means for setting an upper purge rate limit at a ratio of a maximum flow cross sectional area of the purge passage obtained when the flow control valve opens fully with respect to an flow cross sectional area of the induction passage, and means for calculating the maximum possible purge flow rate based on the upper purge rate limit.

39. A system as claimed in claim 38, wherein the accumulating means includes means for accumulating the maximum possible purge flow rate calculated based on the upper purge rate limit when the target purge rate exceeds the upper purge rate limit.

40. A system as claimed in claim 36, wherein the engine operating condition detecting means includes means for detecting an engine intake manifold negative pressure, and wherein the maximum possible purge flow rate calculating means includes means for calculating the maximum possible purge flow rate based on the engine intake manifold negative pressure.

41. A system as claimed in claim 36, wherein the engine operating condition detecting means includes means for detecting an intake air flow rate, and wherein the required purge flow rate calculating means includes means for calculating the required purge flow rate based on the intake air flow rate and a target purge rate calculated based on the accumulated purge flow rate, the target purge rate being a target percentage of the purge flow rate with respect to the intake air flow rate.

42. A system as claimed in claim 41, wherein the engine operating condition detecting means includes means for detecting a flow cross sectional area of the induction passage and means for detecting an engine speed, and wherein the maximum possible purge flow rate calculating means includes means for calculating the maximum possible purge flow rate based on the induction passage flow cross sectional area and the engine speed.

43. A method as claimed in claim 41, wherein the engine operating condition detecting means includes means for detecting a flow cross sectional area of the induction passage, and wherein the maximum possible purge flow rate calculating means includes means for setting an upper purge rate limit at a ratio of a maximum flow cross sectional area of the purge passage obtained when the flow control valve opens fully with respect to an flow cross sectional area of the induction passage, and means for calculating the maximum possible purge flow rate based on the upper purge rate limit.

44. A system as claimed in claim 43, wherein the accumulating means includes means for accumulating the maximum possible purge flow rate calculated based on the upper purge rate limit when the target purge rate exceeds the upper purge rate limit.

45. A system as claimed in claim 41, wherein the engine operating condition detecting means includes means for detecting an engine intake manifold negative pressure, and wherein the maximum possible purge flow rate calculating means includes means for calculating the maximum possible purge flow rate based on the engine intake manifold negative pressure.

* * * * *